US009389578B2

(12) United States Patent
Horikawa et al.

(10) Patent No.: US 9,389,578 B2
(45) Date of Patent: Jul. 12, 2016

(54) IMAGE-FORMING APPARATUS

(71) Applicant: CANON KABUSHIKI KAISHA, Tokyo (JP)

(72) Inventors: Tadashi Horikawa, Numazu (JP); Tetsuya Numata, Suntou-gun (JP); Noriyuki Komatsu, Numazu (JP); Osamu Anan, Susono (JP); Yuichi Sakakibara, Tokyo (JP); Ken Kikuchi, Mishima (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/705,405

(22) Filed: May 6, 2015

(65) Prior Publication Data

US 2015/0323896 A1 Nov. 12, 2015

(30) Foreign Application Priority Data

May 8, 2014 (JP) ..... 2014-096599
Aug. 21, 2014 (JP) ..... 2014-168328
Mar. 19, 2015 (JP) ..... 2015-055899

(51) Int. Cl.
*G03G 21/16* (2006.01)

(52) U.S. Cl.
CPC ..... *G03G 21/1661* (2013.01)

(58) Field of Classification Search
None
See application file for complete search history.

(56) References Cited

U.S. PATENT DOCUMENTS

2010/0124432 A1* 5/2010 Takayama ..... 399/110

FOREIGN PATENT DOCUMENTS

JP 2009-157135 A 7/2009

* cited by examiner

*Primary Examiner* — Clayton E Laballe
*Assistant Examiner* — Jas Sanghera
(74) *Attorney, Agent, or Firm* — Canon USA Inc. IP Division

(57) ABSTRACT

An image-forming apparatus includes an apparatus main body, a cartridge, a movable member, including an attachment portion for attachment of the cartridge, configured to be movable relative to the apparatus main body in a state such that the cartridge is attached to the attachment portion, a protection member configured to protect the cartridge, an engagement member, provided in the cartridge, configured to be movable to an engagement position where an engagement state of the protection member with the cartridge is secured by the engagement member engaging with the protection member, and to a release position where engagement between the protection member and the engagement member is released and removal of the protection member from the cartridge is allowed, and a release member configured to move the engagement member from the engagement position to the release position by abutting the engagement member, when the cartridge is attached to the attachment portion.

20 Claims, 18 Drawing Sheets

IMAGE-FORMING APPARATUS

BACKGROUND OF THE INVENTION

1. Field of the Invention

The present invention relates to an image-forming apparatus.

2. Description of the Related Art

Conventionally, it is known to use a process cartridge system, in an image-forming apparatus employing an electrophotographic image forming process. In the process cartridge system, a photosensitive drum and a developing unit are integral with each other. The developing unit accommodates a developing roller provided to act on the photosensitive drum, and a developer (toner) used for image forming. Meanwhile, there is known a developing cartridge system provided independently of a photosensitive drum, and including only a developing unit. In these cartridge systems, a user can perform maintenance of the apparatus, without relying on a service person. Therefore, these cartridge systems are widely used for electrophotographic image-forming apparatuses.

Japanese Patent Application Laid-Open No. 2009-157135 discusses a technique of allowing work for replacing various cartridges. According to this technique, an attachment member (support member) for attaching a process cartridge and a developing cartridge is provided, and this attachment member (support member) is drawn from an apparatus main body to a predetermined position, so that the cartridge can be replaced. This technique allows a user to replace a developer easily.

However, according to the above-described conventional technique, a photosensitive drum is exposed during attachment/detachment of the process cartridge including the photosensitive drum serving as an image bearing member. Therefore, a surface of the photosensitive drum may be damaged and thus deteriorate, which may adversely affect image quality.

Therefore, it is conceivable to provide a protection member to a cartridge, to protect components including an image bearing member (photosensitive drum) and the like. However, a user may need to remove the protection member before attaching the cartridge to a main body of an image-forming apparatus. Therefore, it is desirable to provide an image-forming apparatus that allows a protection member protecting a cartridge to be removed easily, in attachment/detachment of the cartridge.

SUMMARY OF THE INVENTION

According to an aspect of the present invention, an image-forming apparatus for forming an image on a recording medium, the image-forming apparatus includes an apparatus main body, a cartridge, a movable member, including an attachment portion for attachment of the cartridge, configured to be movable relative to the apparatus main body in a state such that the cartridge is attached to the attachment portion, the movable member being able to be in an inside position located inside the apparatus main body where the cartridge is in a state such that image forming is executable, and in an outside position located outside the apparatus main body where the cartridge is in a state of being attachable to and detachable from the attachment portion, a protection member configured to protect the cartridge, an engagement member, provided in the cartridge, configured to be movable to an engagement position where an engagement state of the protection member with the cartridge is secured by the engagement member engaging with the protection member, and to a release position where engagement between the protection member and the engagement member is released and removal of the protection member from the cartridge is allowed, and a release member configured to move the engagement member from the engagement position to the release position by abutting the engagement member, when the cartridge is attached to the attachment portion, wherein the cartridge is used for image forming in a state such that the protection member is removed from the cartridge.

Further features of the present invention will become apparent from the following description of exemplary embodiments (with reference to the attached drawings).

DESCRIPTION OF THE EMBODIMENTS

Exemplary embodiments of the present invention will be described below with reference to the attached drawings.

(Image-Forming Apparatus)

Figure 1:
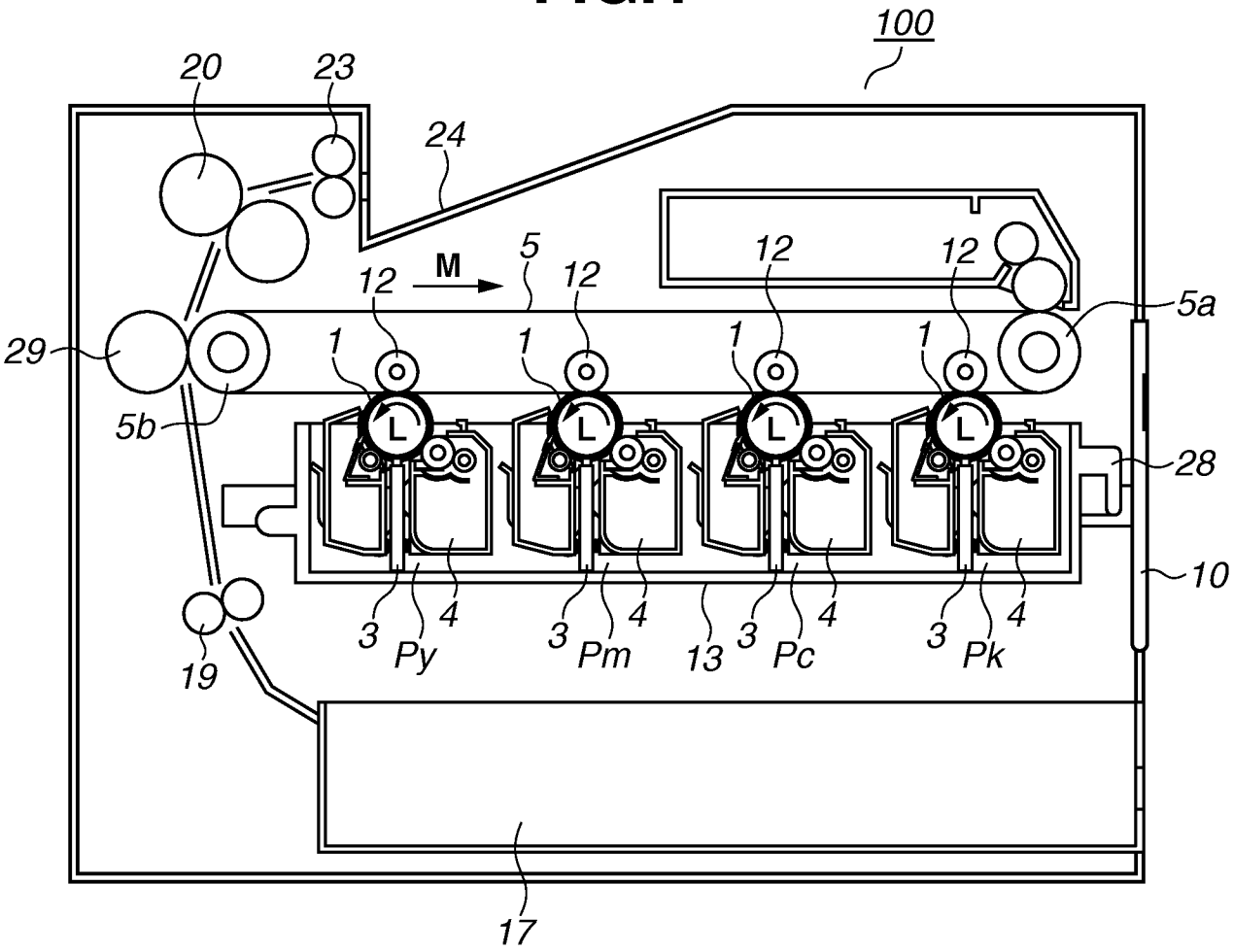
FIG. 1 is a cross-sectional diagram illustrating an image-forming apparatus during an image-forming period.

An electrophotographic-type image-forming apparatus according to a first exemplary embodiment of the present invention will be described using FIGS. 1 through 8A to 8D. FIG. 1 is a schematic cross-sectional diagram illustrating an image-forming apparatus 100. The image-forming apparatus 100 is a four-color (full-color) light emitting diode (LED) printer using an electrophotographic process, and forms a full-color image on a recording medium based on an input signal from an external device.

Figure 4:
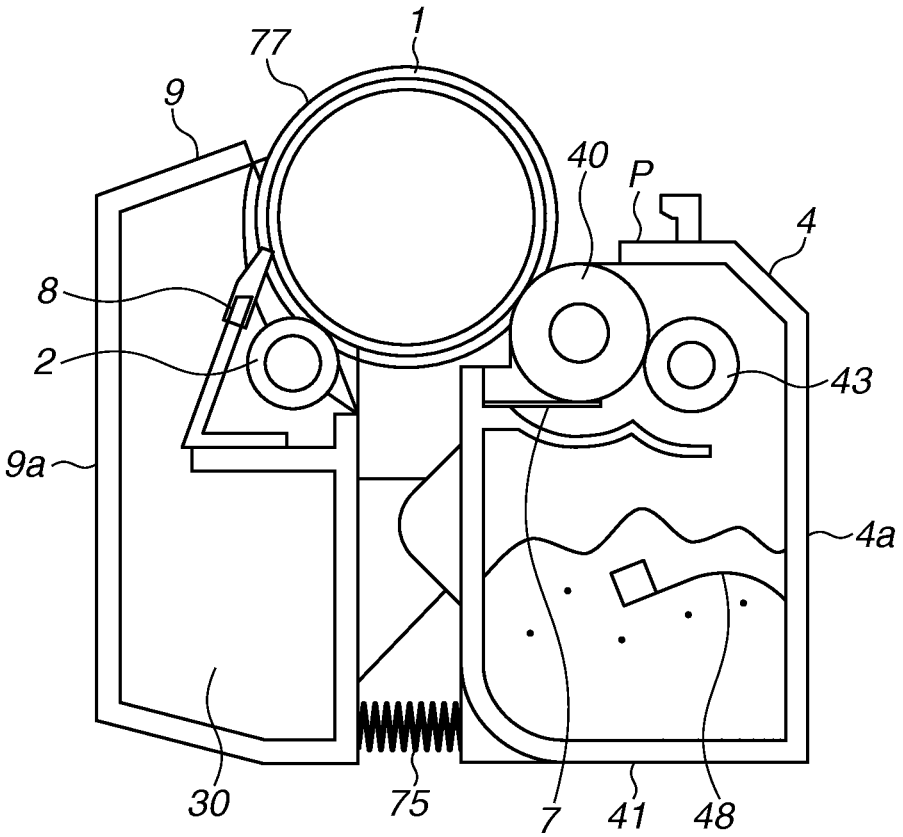
FIG. 4 is a cross-sectional diagram illustrating a process cartridge.

The image-forming apparatus 100 according to the first exemplary embodiment includes four electrophotographic photosensitive members 1 (hereinafter referred to as "photosensitive drum 1") arranged in a horizontal direction. The photosensitive drums 1 illustrated in FIGS. 1 and 4 are each configured to be rotated in an arrow L direction in FIG. 1 by a drive unit (not illustrated). The image-forming apparatus 100 further includes, in addition to the photosensitive drum 1, components such as a charging unit 2 illustrated in FIG. 4, an exposure device 3 illustrated in FIGS. 1 and 4 serving as an exposure member, a developing unit 4 illustrated in FIG. 4, and an electrostatic transfer unit 5 illustrated in FIG. 1, as an electrophotographic image forming process unit.

The charging unit 2 has a function of uniformly charging a surface of the photosensitive drum 1. The exposure device 3 includes, for example, an LED unit. Specifically, the exposure device 3 includes an LED head 3*a* illustrated in FIG. 3A and an LED support member 3*b* illustrated in FIG. 8A. The LED head 3*a* serves as an exposure light source for forming a latent image. The LED support member 3*b* supports and fixes the LED head 3*a* in a rotation axial direction (a longitudinal direction) of the photosensitive drum 1. The exposure device 3 further includes a gap retaining portion 3*c* provided at each of both end parts in the longitudinal direction, to maintain a gap between the photosensitive drum 1 and the LED head 3*a* in a state where a process cartridge P is attached.

The LED head 3*a* is disposed to face a lower part of the photosensitive drum 1 in a vertical direction. In the LED head 3*a*, a plurality of LEDs are disposed on a surface facing the photosensitive drum 1, and aligned in the rotation axial direction (the longitudinal direction) of the photosensitive drum 1. Each of the plurality of LEDs emits light based on a signal transmitted from a control board (not illustrated), so that a latent image is formed on the photosensitive drum 1. According to the present exemplary embodiment, the LED unit is taken as an example of the exposure device (the exposure light source) 3. However, the exposure device 3 may be configured of other type of component, such as an electroluminescence (EL) element.

The developing unit 4 has a function of developing the electrostatic latent image formed on the surface of the photosensitive drum 1, by using toner that is a developer, to form a toner image. Further, the electrostatic transfer unit 5 has a function of transferring the toner image on the photosensitive drum 1, to a sheet material serving as a recording medium (a recording material) that is a material on which the toner image is to be transferred. Specific examples of the sheet material may include paper, an overhead projector (OHP) sheet, and cloth. The image-forming apparatus 100 further includes a cleaning member 8 illustrated in FIG. 4. The cleaning member 8 is provided to remove the toner remaining on the surface of the photosensitive drum 1 after the transfer.

The photosensitive drum 1 is, for example, an aluminum cylinder having an outer peripheral surface to which an organic photoconductive layer (an organic photoconductor (OPC)) is applied. The both end parts of the photosensitive drum 1 is rotatably supported by a support member (not illustrated). A drum coupling for receiving a driving force from a drive motor (not illustrated) is disposed at one of the ends. Therefore, the photosensitive drum 1 rotates in the arrow L direction in FIG. 1, by receiving the driving force transmitted from the drive motor via the drum coupling.

The charging unit 2 according to the present exemplary embodiment employs a contact charging method. Specifically, a charging device (hereinafter referred to as "charging roller") 2, is a conductive roller formed in a roll shape. The charging roller 2 abuts the surface of the photosensitive drum 1. The surface of the photosensitive drum 1 is uniformly charged by applying a charging bias voltage to the charging roller 2.

The developing units 4 each include a different one of toner containers 41*y*, 41*m*, 41*c*, and 41*k* containing yellow, magenta, cyan, and black toner (a toner container 41 for one color is illustrated in FIG. 4, as an example). The toner containers 41*y*, 41*m*, 41*c*, and 41*k* are developer storage portions each storing the developer (the toner) to be supplied to a developing roller 40. The toner in each of the toner containers 41*y*, 41*m*, 41*c*, and 41*k* is conveyed to a toner-supplying roller 43 illustrated in FIG. 4.

The toner-supplying roller 43, together with a developing blade 7 illustrated in FIG. 4, applies the toner to the outer periphery of the developing roller 40, and an electric charge is applied to the toner. The developing blade 7 is in pressure contact with an outer periphery of the developing roller 40.

A developing bias is applied to the developing roller 40 and the toner adheres to a latent image formed on the photosensitive drum 1 applying, so that a toner image (a developer mage) is formed. In other words, the photosensitive drum 1 is an image bearing member that bears an image (a toner image). Further, the developing roller is a developer bearing member that bears a developer (toner) to develop a latent image.

The developing roller 40 is disposed to face and to be in contact with the photosensitive drum 1. Here, the developing unit 4 and the photosensitive drum 1 integrally form the process cartridge P (Py, Pm, Pc, and Pk). The process cartridge P is capable of being replaced as a whole, when the lifetime expires due to consumption of the toner by a user.

An operation of forming a full-color image is as follows. The photosensitive drum 1 of each of the process cartridges P is driven to rotate at a predetermined control speed in the arrow L direction in FIG. 1. The charging roller 2 rotates by following the photosensitive drum 1. Further, the electrostatic transfer unit 5 is driven to rotate at a speed corresponding to the speed of the photosensitive drum 1 in an arrow M direction in FIG. 1. The electrostatic transfer unit 5 is a dielectric endless belt having flexibility, and held around a drive roller 5*a* and an opposing roller 5*b* for secondary-transfer, while being stretched between them. The endless belt that forms the electrostatic transfer unit 5 extends in a direction substantially identical with a moving direction of a drawer member 13 described below. In addition, the endless belt that forms the electrostatic transfer unit 5 extends in the longitudinal direction of the photosensitive drum 1.

The developing roller 40 is rotated by a gear following the photosensitive drum 1, and the toner-supplying roller 43 illustrated in FIG. 4 is rotated by a gear following the developing roller 40. In synchronization with this driving, a predetermined charging bias is applied to the charging roller 2, in a predetermined control timing in each of the process cartridges P. As a result, the charging roller 2 uniformly charges the surface of the photosensitive drum 1, at predetermined polarity and potential.

The exposure member 3 exposes the surface of the photosensitive drum 1 of each of the process cartridges P, to information light according to an image signal of each of Y (yellow), M (magenta), C (cyan), and K (black) colors. As a result, an electrostatic latent image according to the image signal corresponding to each color is formed on the surface of the photosensitive drum 1 of each of the process cartridges P. In each of the process cartridges P, the developing roller 40 then develops the electrostatic latent image formed on the surface of the photosensitive drum 1, so that a developer image is formed.

Subsequently, in each of the process cartridges P, a predetermined developing bias is applied to the developing roller 40 in a predetermined control timing. By such electrophotographic image forming process operation, for example, a yellow developer image corresponding to a yellow component of a full-color image is formed on the photosensitive drum 1 of the process cartridge Py.

Next, the developer image is subjected to primary transfer onto the electrostatic transfer unit 5, at a primary transfer nip portion that is an abutment portion between the photosensitive drum 1 and the electrostatic transfer unit 5. A primary transfer roller 12 illustrated in FIG. 1 is in pressure contact with the photosensitive drum 1, with the electrostatic transfer unit 5 interposed therebetween. This forms the primary transfer nip portion. Likewise, a magenta developer image, a cyan developer image, and a black developer image are subjected to the primary transfer onto the electrostatic transfer unit 5 via the respective photosensitive drums 1, in the process cartridge Pm, the process cartridge Pc, and the process cartridge Pk, respectively.

In this way, a full-color yet-to-be-fixed developer image of four colors of yellow+magenta+cyan+black is formed on the electrostatic transfer unit 5, by combining the respective developer images. A color order of sequentially transferring the developer images for superimposition onto the electrostatic transfer unit 5 is not limited to the order described above. In each of the process cartridges P, the cleaning member 8 illustrated in FIG. 4 removes residual developer on the surface of the photosensitive drum 1 after the primary transfer of the developer image onto the electrostatic transfer unit 5. The removed residual developer is then sent to a residual toner container 30.

Meanwhile, sheet-like recording mediums (materials on which an image is to be transferred) 1 stacked and stored in a feeding cassette 17 illustrated in FIG. 1 are each fed in a predetermined control timing. A registration roller pair 19 then guides the recording medium to a secondary transfer nip portion that is an abutment portion between the electrostatic transfer unit 5 and a secondary transfer roller 29, in a predetermined control timing.

A secondary transfer bias at a predetermined potential and a polarity opposite to the charging polarity of the developer is applied to the secondary transfer roller 29 illustrated in FIG. 1, in a predetermined control timing. Therefore, in a process in which the recording medium is conveyed while being pinched at the secondary transfer nip portion, a four-color superimposed developer image on the electrostatic transfer unit 5 is subjected to secondary transfer to a surface of the recording medium. After passing through the secondary transfer nip portion, the recording medium is separated from a surface of the electrostatic transfer unit 5, and then guided to a fixing device 20 illustrated in FIG. 1, to be pressurized and heated at a fixing nip portion.

As a result, the colors of the respective developer images are combined and the full-color developer image is fixed to the recording medium. The recording medium then leaves the fixing device 20, to be discharged onto a discharge tray 24 by a discharge roller pair 23, as a full-color-image-formed object.

According to the present exemplary embodiment, a shift mechanism (not illustrated) allows the secondary transfer roller 29 to move between a first position where the secondary transfer nip portion is formed by abutment between the secondary transfer roller 29 and the electrostatic transfer unit 5, and a second position where the secondary transfer roller 29 is away and not in contact with the electrostatic transfer unit 5. The secondary transfer roller 29 moves to the first position in an image-forming operation period of the image-forming apparatus 100, and moves to the second position in a non-image-forming period. The secondary transfer roller 29 can also be configured to keep abutting the electrostatic transfer unit 5.

According to the present exemplary embodiment, the electrostatic transfer unit 5 is disposed above the photosensitive drum 1, and the exposure device 3 is disposed below the photosensitive drum 1, in the vertical direction. Therefore, the full-color yet-to-be-fixed developer image of four colors of yellow, magenta, cyan, and black can be transferred to a recording medium via the secondary transfer roller 29, upon being formed on the electrostatic transfer unit 5. Accordingly, the time taken before output of a first printout is short, which is advantageous.

(Drawer Member)

The drawer member 13 will be described below. The drawer member 13 serves as an attachment member (a support member) movable between an inside position (an image-forming position) located inside an apparatus main body, and an outside position (a cartridge attachment/detachment position) located outside the apparatus main body, while the photosensitive drum 1 is attached to (supported by) the drawer member 13.

According to the present exemplary embodiment, the apparatus main body corresponds various members of the image-forming apparatus 100, except at least the drawer member 13 and members configured to be fixed to or attachable to/detachable from the drawer member 13.

Figure 2:
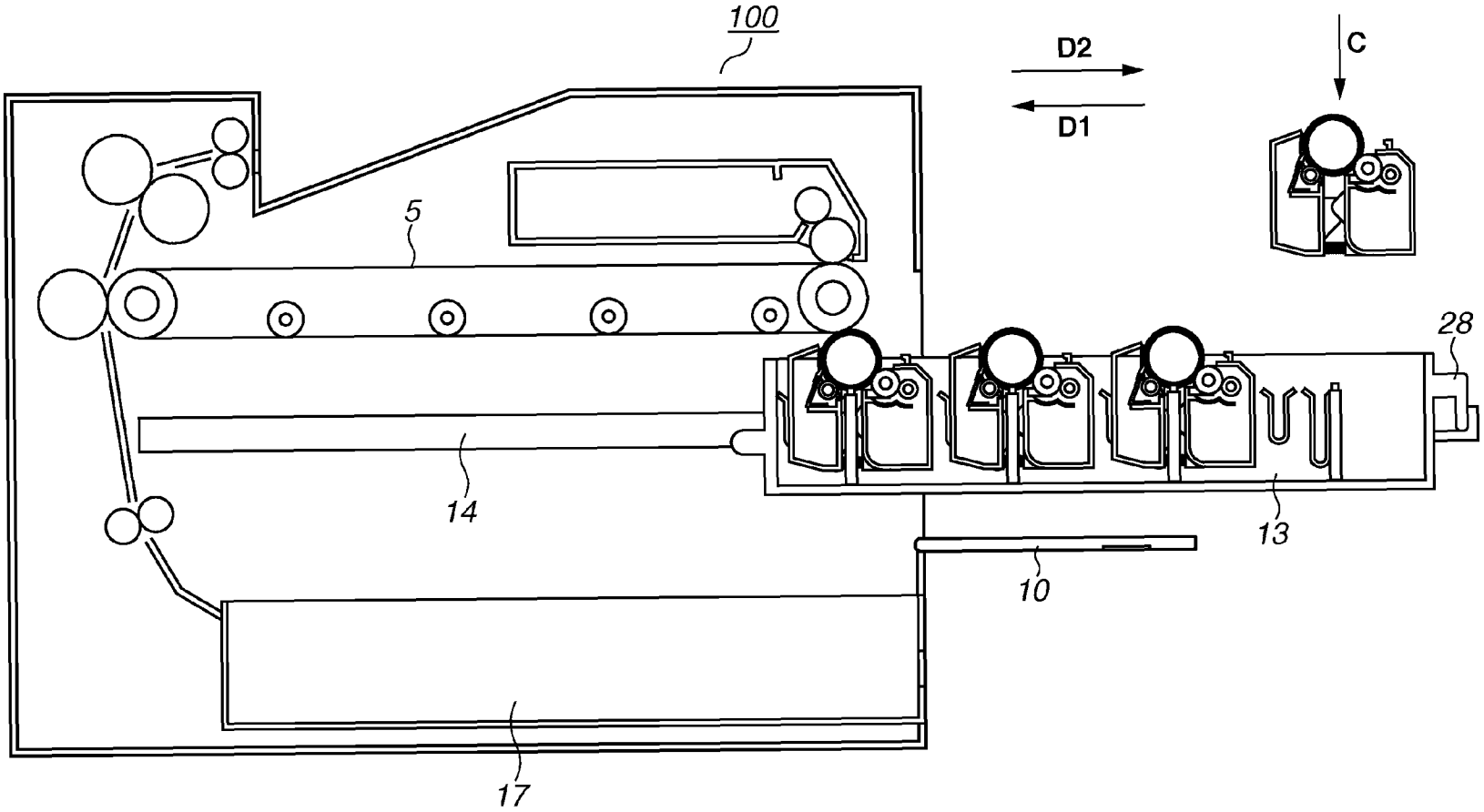
FIG. 2 is a cross-sectional diagram illustrating attaching a drawer member in the image-forming apparatus.

As illustrated in FIG. 2, the drawer member 13 is a movable member provided to be capable of linearly moving (being inserted/drawn) in a horizontal direction (an arrow D1 direction and an arrow D2 direction) relative to the apparatus main body. The drawer member 13 is movable between the inside position of being stored in the apparatus main body as illustrated in FIG. 1, and the outside position of being drawn out of the apparatus main body as illustrated in FIG. 2.

In the state where the drawer member 13 is at the outside position, the user attaches the process cartridge P (Py, Pm, Pc, and Pk) to the drawer member 13, by moving the process cartridge P in an arrow C direction that is a gravitational direction (the vertical direction). The process cartridge P thus attached is disposed so that the longitudinal direction that is the axial direction of the photosensitive drum 1 is orthogonal to a moving direction of the drawer member 13. Further, the four process cartridges Py, Pm, Pc, and Pk are aligned in the arrow D1 direction that is the moving direction of the drawer member 13.

Together with the drawer member 13, the process cartridges P are moved into the apparatus main body in a state of being attached to the drawer member 13. A door 10 is then closed in a state where the drawer member 13 is inside the apparatus main body, and all the process cartridges P are positioned at a predetermined location in the apparatus main body.

In this way, with the image-forming apparatus 100 according to the present exemplary embodiment, the four process cartridges P can be collectively inserted into the apparatus main body, and can be collectively drawn out of the apparatus main body. Therefore, workability in replacement of the process cartridge P is superior to a case where a configuration of individually attaching cartridges to an apparatus main body is adopted.

(Specific Configuration of Drawer Member)

A specific configuration of the drawer member 13 will be described in detail below, by using FIGS. 3A and 3B. At four corners of the drawer member 13, guided portions 13*a*, 13*b*, 13*c*, and 13*d* to be guided by a guide portion 14 of the apparatus main body are provided. The guided portions 13*a* and 13*b* each have a shape protruding from a side surface, and extend in a drawing direction to prevent the drawer member 13 from tilting at a drawn position. Further, the guided portions 13*c* and 13*d* each have a cylindrical shape and protrude outward from the corresponding side surface.

Furthermore, at one end of the drawer member 13, a grip portion 28 is provided for an operation of the drawer member 13 by the user.

In the drawer member 13, the exposure device 3 serving as the exposure light source for forming a latent image is disposed at a part to which each of the process cartridges P is to be attached. Further, guide portions 13*h*, 13*i*, 13*j*, and 13*k* are arranged at each of one end and the other end of the part to which each of the process cartridges P is to be attached. The guide portions 13*h*, 13*i*, 13*j*, and 13*k* are attachment portions for attaching each of the process cartridges P to the inside of the drawer member 13. Each of the guide portions 13*h*, 13*i*, 13*j*, and 13*k* extends in the vertical direction, as illustrated in FIGS. 3A and 3B. Further, a partition member 15 is provided at the part to which each of the process cartridges P is to be attached.

(Cartridge)

A configuration of the process cartridge P to be attached to the drawer member 13 will be described using FIG. 4 as well as FIGS. 5A and 5B. In FIG. 4, the process cartridge P includes a photosensitive member unit 9 that is an image bearing member unit, and the developing unit 4 that is a developer bearing member unit. The photosensitive member unit 9 includes the photosensitive drum 1 that is the image bearing member, a photosensitive member frame 9*a* supporting the photosensitive drum 1, the charging unit 2, the cleaning member 8, and the residual toner container 30 for containing the toner removed by the cleaning member 8.

Further, the developing unit 4 includes the developing roller 40 that is the developer bearing member, a developing frame 4*a* supporting the developing roller 40, the toner-supplying roller 43, the developing blade 7, and the toner container 41 illustrated in FIG. 4. The toner container 41 is provided to contain the toner to be used for image forming. The developing unit 4 further includes a conveyance member 48 illustrated FIG. 4. The conveyance member 48 is provided to supply the toner in the toner container 41.

As described above, the toner in the toner container 41 is sent to the toner-supplying roller 43, by the conveyance member 48. The toner-supplying roller 43, together with the developing blade 7 in pressure contact with the outer periphery of the developing roller 40, subsequently applies the toner to the outer periphery of the developing roller 40, and an electric charge is applied to the toner. Afterward, by application of a developing bias to the developing roller 40 from the apparatus main body, the toner adheres to a latent image formed on the photosensitive drum 1, so that a toner image is formed.

The toner image on the photosensitive drum 1 after the development is transferred to a sheet material. Subsequently, the cleaning member 8 removes the residual toner on the surface of the photosensitive drum 1, and the residual toner container 30 receives the removed residual toner. When the toner in the toner container 41 is consumed, the user can resume printing by replacing the process cartridge P.

Figure 5A:
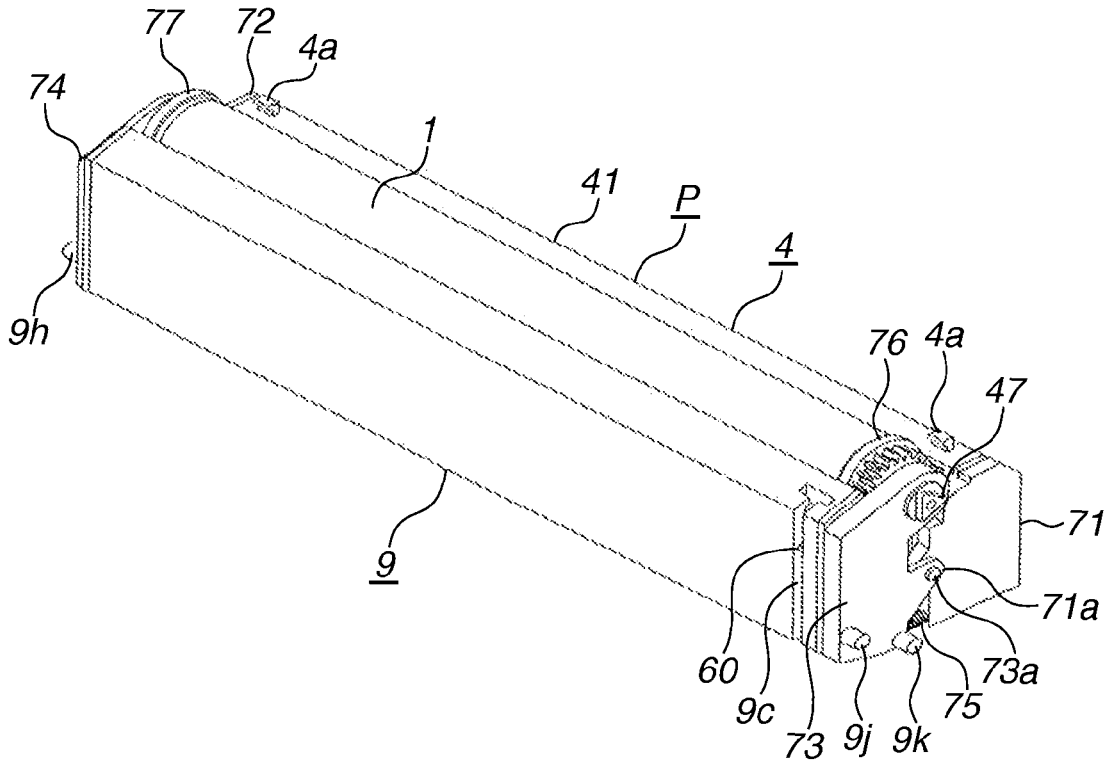
FIG. 5A is a perspective diagram illustrating the process cartridge.
Figure 5B:
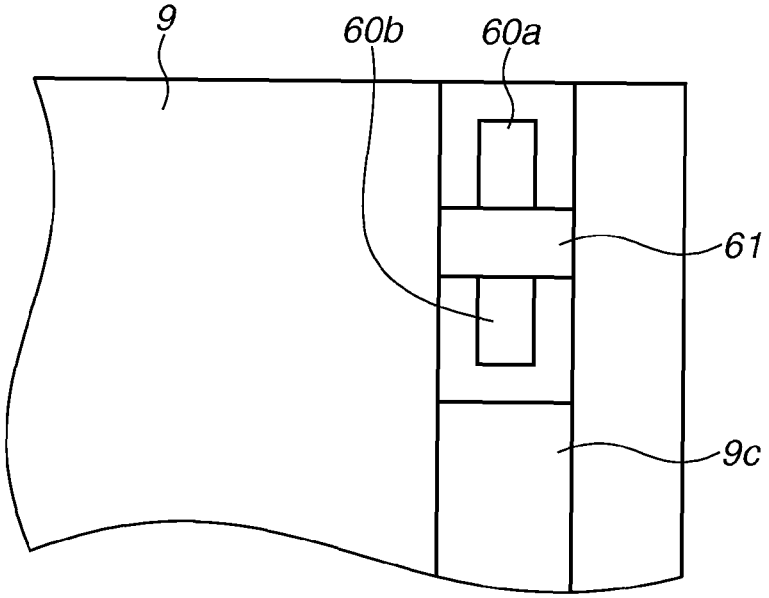
FIG. 5B is an explanatory diagram illustrating inside of a groove formed in an attachment direction of the process cartridge.

As illustrated in FIG. 5A, a coupling member 47 is rotatably supported at one end of the process cartridge P in the longitudinal direction, to receive a driving force from a drum coupling member provided on the apparatus main body side. The coupling member 47 is provided at one end of the photosensitive drum 1, so that the photosensitive drum 1 is rotated by the driving force received by the coupling member 47 from the apparatus main body. The driving force received by the coupling member 47 is then transmitted to the developing roller 40, the toner-supplying roller 43, and the conveyance member 48 via a gear, so that these rollers and member rotate by following the photosensitive drum 1.

Further, a developing-unit driving-side side cover 71 and a developing-unit driven-side side cover 72 are provided at both end parts of the toner container 41 in the longitudinal direction, respectively. The developing-unit driving-side side cover 71 and the developing-unit driven-side side cover 72 have engagement portions 71*a* and 72*a*, respectively.

Furthermore, a photosensitive-member-unit driving-side side cover 73 and a photosensitive-member-unit driven-side side cover 74 are provided at both end parts of the residual toner container 30 in the longitudinal direction, respectively. The photosensitive-member-unit driving-side side cover 73 and the photosensitive-member-unit driven-side side cover 74 have aperture portions 73*a* and 74*a*, respectively. The photosensitive member unit 9 and the developing unit 4 are coupled to each other, by engagement of the engagement portions 71*a* and 72*a* in the aperture portions 73*a* and 74*a*, respectively.

Here, the engagement portions 71*a* and 72*a* are configured to be rotatable relative to the aperture portions 73*a* and 74*a*, respectively. Therefore, the developing unit 4 can move relative to the photosensitive member unit 9. In other words, the developing roller 40 is configured to be movable relative to the photosensitive drum 1.

A spring 75 illustrated in FIGS. 4 and 5A serves as an urging member, and is disposed between the photosensitive member unit 9 and the developing unit 4. The spring 75 is provided to press the developing roller 40 against the photosensitive drum 1, with a predetermined pressure.

Further, gap-retaining members 77 and 76 illustrated in FIG. 5A are disposed on the same axis as that of the photosensitive drum 1. The gap retaining members 77 and 76 have a function of retaining a fixed gap between the photosensitive drum 1 and the LED head 3*a*, by each abutting the corresponding gap retaining portion 3*c* of the exposure device 3. A groove 9*c* illustrated in FIGS. 5A and 5B is formed along an attachment direction of the process cartridge P, and a photosensitive member protection member (a protection member) described below is released from engagement, in this groove.

(Attachment of Process Cartridge)

Figure 6A:
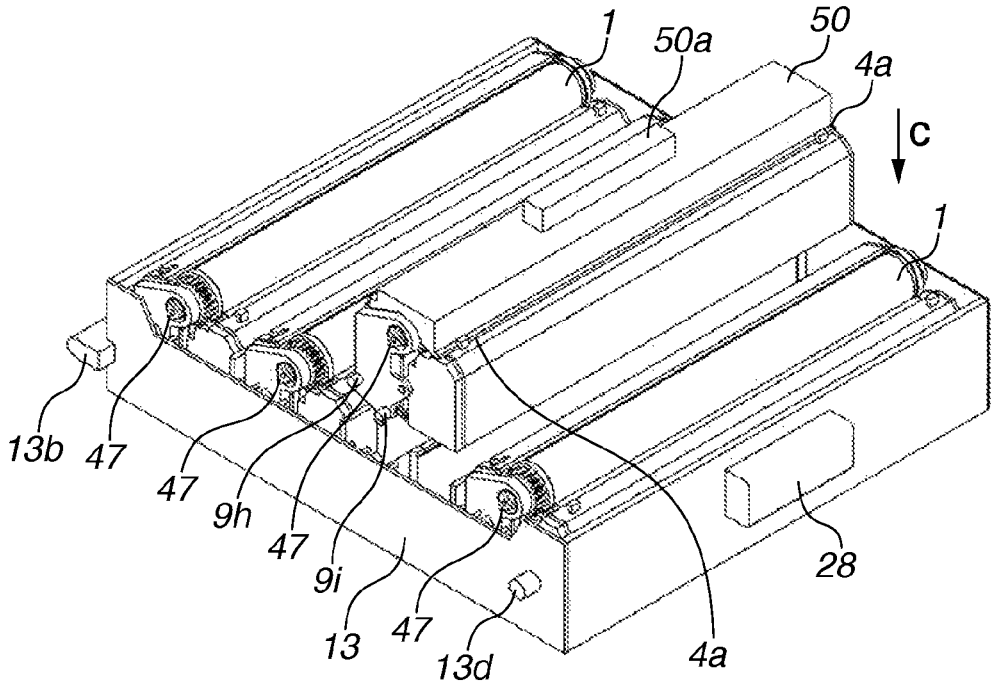
FIGS. 6A and 6B are perspective diagrams each illustrating how the process cartridge is attached to the drawer member in the image-forming apparatus.
Figure 6B:
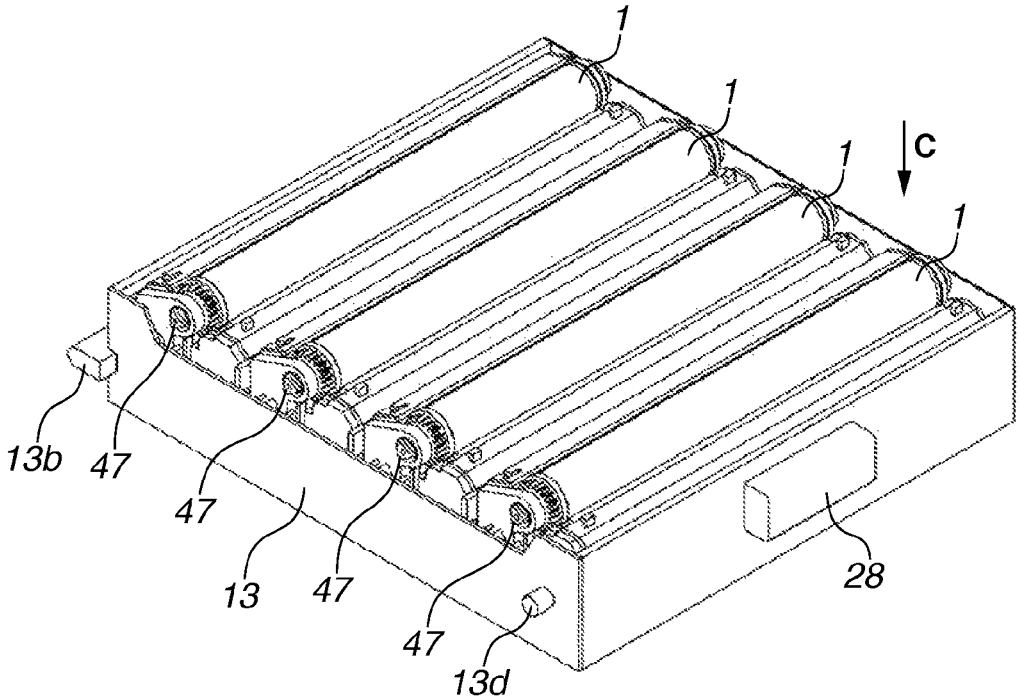

Next, attachment of the process cartridge P to the drawer member 13 will be described using FIGS. 6A and 6B. The process cartridges Py, Pm, Pc, and Pk are attached to the respective attachment portions provided at four locations in the drawer member 13.

The user holds the process cartridge P by gripping a grip portion 50*a* provided on top of a photosensitive member protection member 50 with a hand, and moves the process cartridge P in an arrow C direction that is the gravitational direction. The user then attaches the process cartridge P, by sliding regulated portions 9*h*, 9*i*, 9*j*, and 9*k* provided at both end parts of the process cartridge P, along the guide portions 13*h*, 13*i*, 13*j*, and 13*k* of the drawer member 13. The process cartridge P is thus guided by each of the guide portions 13*h*, 13*i*, 13*j*, and 13*k*, and attached to the inside of the drawer member 13 serving as the attachment member.

Figure 3A:
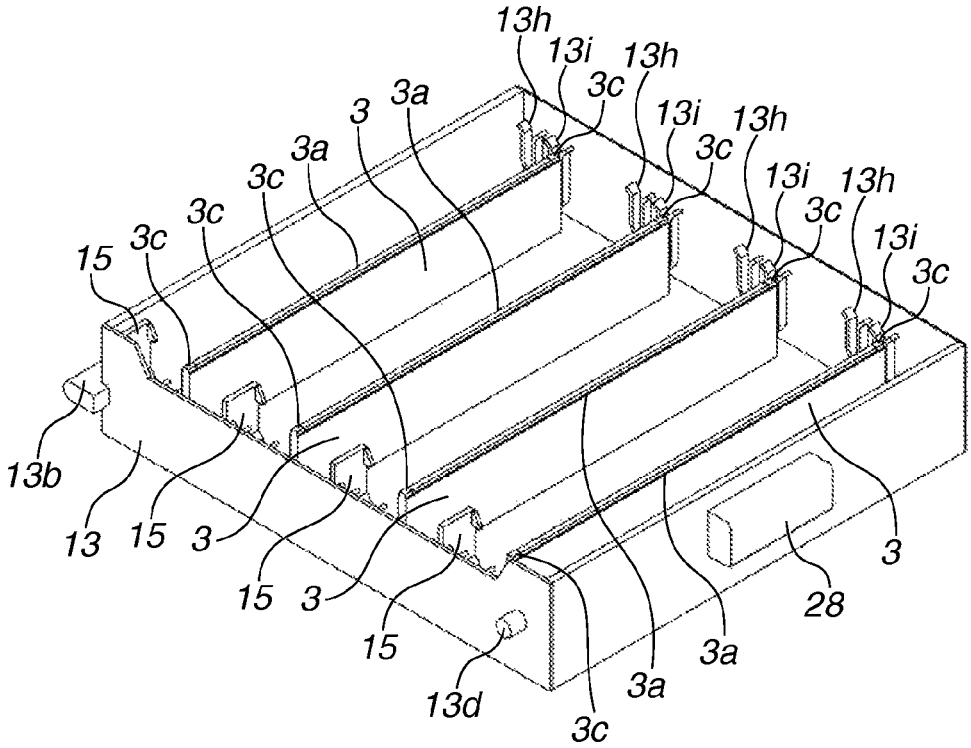
FIGS. 3A and 3B are perspective diagrams each illustrating the drawer member, viewed from mutually opposite directions in the image-forming apparatus.
Figure 3B:
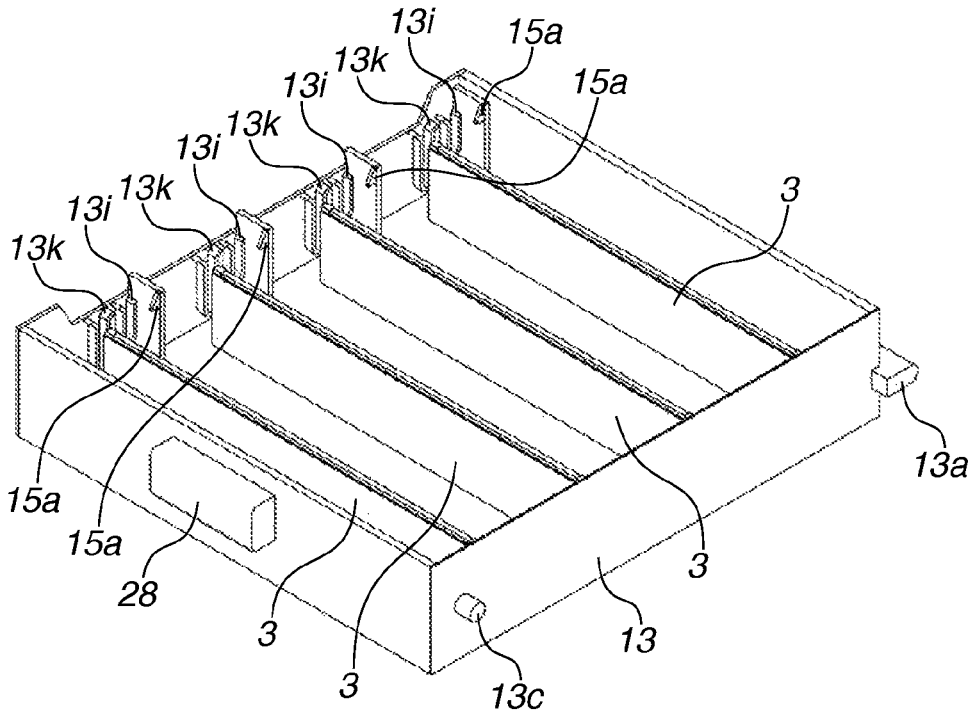

When the process cartridge P is attached to the drawer member 13, the gap retaining members 77 and 76 each abut the corresponding gap retaining portion 3*c* illustrated in FIG. 3A of the exposure device 3, to position the process cartridge P in the arrow C direction that is the attachment direction. When the process cartridge P is in an attached state, the user can remove the photosensitive member protection member 50 by pulling the grip 50. Details of this configuration will be described below.

(Photosensitive Member Protection Member)

Figure 7A:
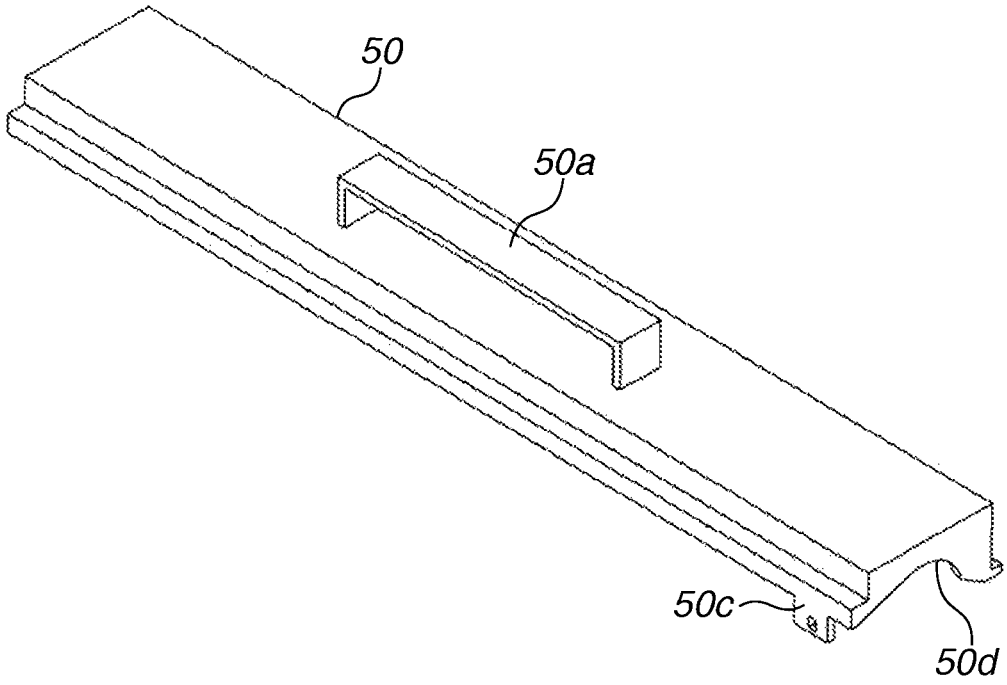
FIGS. 7A and 7B are perspective diagrams each illustrating a configuration of a photosensitive member protection member, viewed from mutually opposite directions in the image-forming apparatus.
Figure 7B:
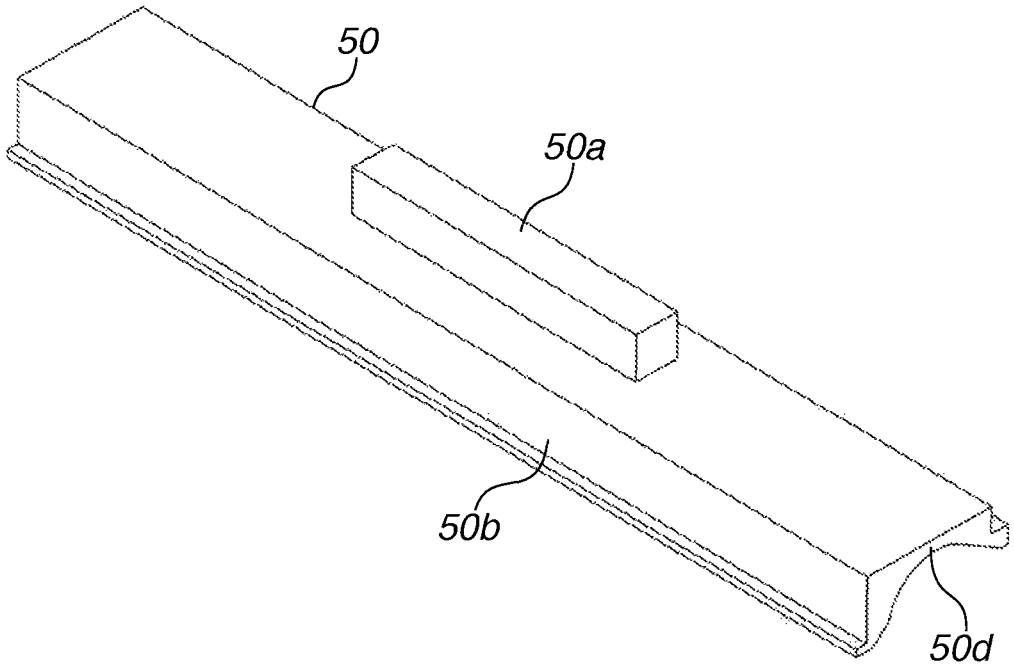

A configuration of the photosensitive member protection member 50 will be described using FIGS. 7A and 7B. The photosensitive member protection member 50 is disposed to cover the entire photosensitive drum 1 in the longitudinal direction, as a protection member for protecting the surface of the photosensitive drum 1 that is the image bearing member (covering an exposed part of the photosensitive drum 1). The photosensitive member protection member 50 includes the grip portion 50*a* that allows the user to hold the photosensitive member protection member 50 and the process cartridge P connected to the photosensitive member protection member 50. Therefore, the user can hold the process cartridge P in a stable posture by gripping the grip portion 50*a*, when attaching the process cartridge P.

Figure 8A:
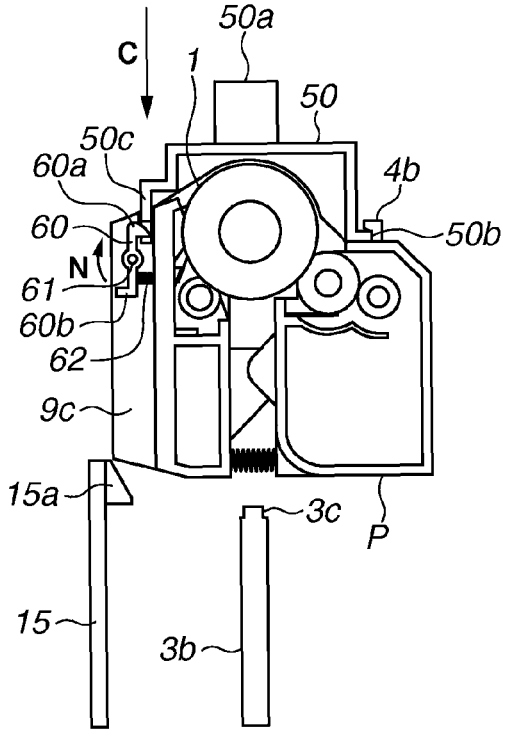
FIGS. 8A, 8B, 8C, and 8D are side views each illustrating movement of releasing the photosensitive member protection member in an operation of attaching the process cartridge.
Figure 8B:
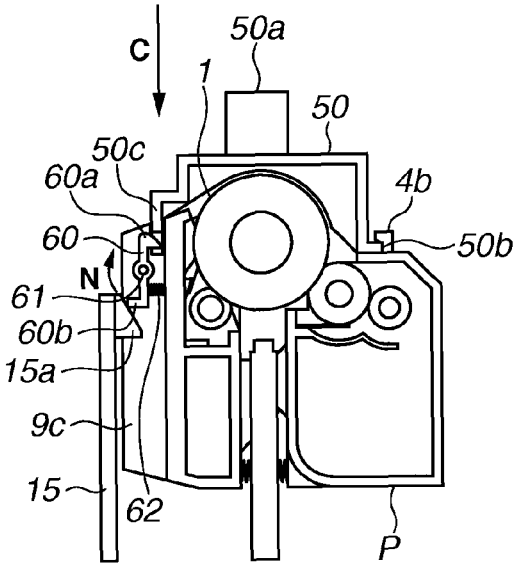

Further, the photosensitive member protection member 50 has a locked portion 50*b*, and a hole 50*c* serving as a locked portion, to be locked by the process cartridge P, as will be described below. The photosensitive member protection member 50 and the process cartridge P are connected and fixed to each other, by engagement of the locked portion 50*b* and the hole 50*c*, with a locking portion 4*b* and a locking portion 60*a*, respectively, which are illustrated in FIGS. 8A to 8B. The locking portion 4*b* belongs to the process cartridge P, and the locking portion 60*a* belongs to a connection member (engagement member) 60 described below. The connection member 60 is included in the photosensitive member unit 9, and rotatable relative to the photosensitive member unit 9.

(Attachment/Detachment of Photosensitive Member Protection Member)

The photosensitive member protection member 50 protects the photosensitive drum 1 in a state of being secured to the process cartridge P, when the process cartridge P is stored (not in use). On the other hand, it is necessary to remove the photosensitive member protection member 50 from the process cartridge P, when the process cartridge P is to be used in the image-forming apparatus 100 to perform image forming. In this respect, attachment/detachment of the photosensitive member protection member 50 will be described below using FIGS. 8A to 8D.

The process cartridge P includes the connection member (the engagement member) 60, as a connection unit (an engagement unit) to the photosensitive member protection member 50. The connection member 60 turns about a shaft 61, and is urged by a spring 62 in an arrow N direction. The connection member 60 has the locking portion 60*a* at a leading end. The connection member 60 engages with the photosensitive member protection member 50, by inserting the locking portion 60*a* into the hole 50*c* serving as the locked portion of the photosensitive member protection member 50. The photosensitive member protection member 50 is thereby connected and fixed to the process cartridge P (a state of the photosensitive member protection member 50 being attached).

Further, the process cartridge P has the locking portion (an engagement portion) 4*b* illustrated in FIG. 8A, as a connection unit to the photosensitive member protection member 50. The locking portion 4*b* has a shape protruding from a container of the developing unit 4. The shape of the locking portion 4*b* corresponds to the locked portion 50*b* of the photosensitive member protection member 50, so as to prevent the process cartridge P from being separated from the photosensitive member protection member 50, even if the photosensitive member protection member 50 is moved in the arrow C direction in FIG. 8A relative to the process cartridge P. The locking portion 4*b* is an engagement portion configured to engage with the photosensitive member protection member 50, at a location different from a location of the connection member (the engagement member) 60.

In the state illustrated in FIG. 8A, the user attaches the process cartridge P, by moving, the process cartridge P in the arrow C direction that is the attachment direction of the process cartridge P, along the guide portions 13*h*, 13*i*, 13*j*, and 13*k*, while gripping the grip portion 50*a*. When the process cartridge P arrives at a position illustrated in FIG. 8B, an abutment portion 60*b* of the connection member (the engagement member) 60 abuts a contact surface (an abutment portion) 15*a* that is a slope portion of the partition member (an abutment member) 15. The process cartridge P is then further pressed in the arrow C direction, so that the connection member 60 pivots on the shaft 61 in a direction opposite to the arrow N direction.

The contact surface (the slope portion) 15*a* capable of abutting the connection member (the engagement member) 60 slopes relative to the attachment direction (the arrow C direction) of the process cartridge P. Therefore, when abutting the connection member 60, the contact surface 15*a* allows the connection member 60 to pivot smoothly.

Figure 8C:
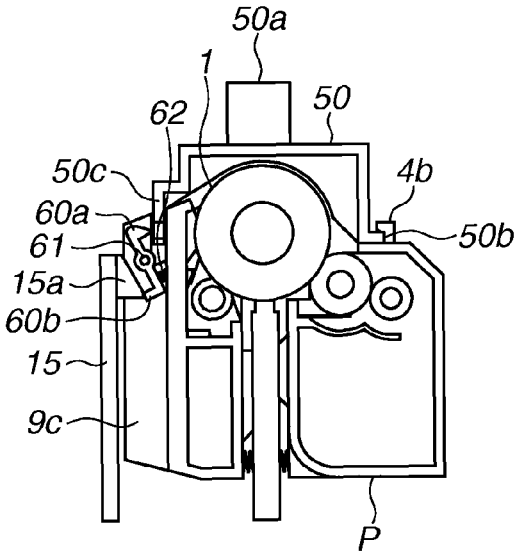

When the process cartridge P is further pressed to be in the state illustrated in FIG. 8C and the connection member 60 reaches a release position upon pivoting, insertion of the locking portion 60*a* into the hole 50*c* is released. As a result, fixing of the photosensitive member protection member 50 to the process cartridge P is released. In other words, the connection member (the engagement member) 60 pivots by abutting the contact surface 15*a*, thereby shifting from an engagement position illustrated in FIGS. 8A and 8B to the release position illustrated in FIG. 8C. The engagement position is a position where the connection member 60 engages with the photosensitive member protection member 50. When the connection member 60 is at the engagement position, the photosensitive member protection member 50 remains secured to the process cartridge P.

On the other hand, the release position is a position where engagement between the connection member 60 and the photosensitive member protection member 50 is released. When the connection member 60 is at the release position, removal of the photosensitive member protection member 50 from the process cartridge P is allowed.

Figure 8D:
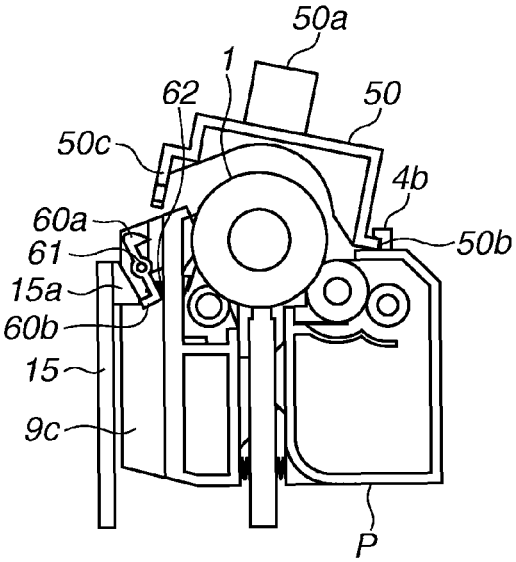

In other words, the partition member 15 is a release member (a release portion) provided to release an engaged state (a fixed state) of the photosensitive member protection member 50 and the process cartridge P. The user can then remove the photosensitive member protection member 50 as illustrated in FIG. 8D, by pulling the grip portion 50*a* of the photosensitive member protection member 50 in a direction opposite to the arrow C direction, by gripping the grip portion 50*a* in the state illustrated in FIG. 8C.

(Effects of Present Exemplary Embodiment)

As described above, according to the image-forming apparatus 100 of the present exemplary embodiment, it is difficult to remove the photosensitive member protection member 50 from the process cartridge P, until immediately before the process cartridge P is attached to the image-forming apparatus 100. Therefore, it is possible to suppress unintentional removal of the photosensitive member protection member 50, when the process cartridge P is stored.

Further, the connection member 60 is embedded in the groove 9*c* of the process cartridge P, and therefore, it is difficult for the user to operate the connection member 60 without a tool, at any time except when the process cartridge P is attached or detached. Therefore, the photosensitive drum 1 can be protected more reliably than conventional cases.

In addition, it is difficult to operate the drawer member 13 in the state where the photosensitive member protection member 50 is connected to the process cartridge P. Therefore, members such as the electrostatic transfer unit 5, which are present in proximity to a space related to drawing of the drawer member 13, are less likely to be damaged.

Moreover, engagement and release of the photosensitive member protection member 50 can be performed by pivoting of the connection member 60. Therefore, these engagement and release can be performed, without causing a change in a relative arrangement of the photosensitive member unit 9 serving as the image bearing member unit and the developing unit 4 serving as the developer bearing member unit.

Further, the photosensitive drum 1 is disposed upstream of (above, in FIG. 8A) the process cartridge P in the direction of attaching the process cartridge P (an arrow C direction in FIG. 8A) to the drawer member 13 serving as the attachment member. Therefore, if the photosensitive drum 1 is exposed, the user may unintentionally touch the photosensitive drum 1, before attaching the process cartridge P to the drawer member (the attachment member) 13. This may damage the photosensitive drum 1.

However, according to the present exemplary embodiment, the photosensitive member protection member 50 protects the photosensitive drum 1, until immediately before the process cartridge P is attached to the drawer member 13. Therefore, even if the photosensitive drum 1 is disposed upstream of the process cartridge P, an occurrence of an event, such as an unintentional touch, on the photosensitive drum 1 by the user can be suppressed, and thus damage to the photosensitive drum 1 can be suppressed.

The exemplary embodiment has been described above, but the present invention is not limited thereto, and may be variously modified within the scope of the gist thereof.

According to the exemplary embodiment described above, the process cartridge allows the image bearing member unit and the developer bearing member unit to be integrally attached to/detached from the attachment member. Alternatively, the image bearing member unit may be attached to/detached from the attachment member, independently of the developer bearing member unit.

According to the exemplary embodiment described above, the engagement of the photosensitive member protection member 50 is partially released (only the engagement in the hole 50*c*, between the hole 50*c* and the locked portion 50*b* each serving as the locked portion, is released). However, the engagement of the photosensitive member protection member 50 may be entirely released. In other words, both the hole 50*c* and the locked portion 50*b* each serving as the locked portion may be released from the engagement.

According to the exemplary embodiment described above, the electrostatic transfer unit 5 is described as an example of the transfer member, but an image-forming apparatus according to the present invention is not limited to this example. In other words, the present invention is also applicable to a direct transfer member included in a configuration in which a sheet material serving as a material on which an image is to be transferred is conveyed to the surface of the photosensitive drum 1, and the direct transfer member directly transfers a developer image on the photosensitive drum 1 to the sheet material.

According to the exemplary embodiment described above, the attachment member exemplified by the drawer member 13 is a movable member, but may be a stationary member.

Next, a second exemplary embodiment will be described using the attached drawings.

(Image-Forming Apparatus)

Figure 10:
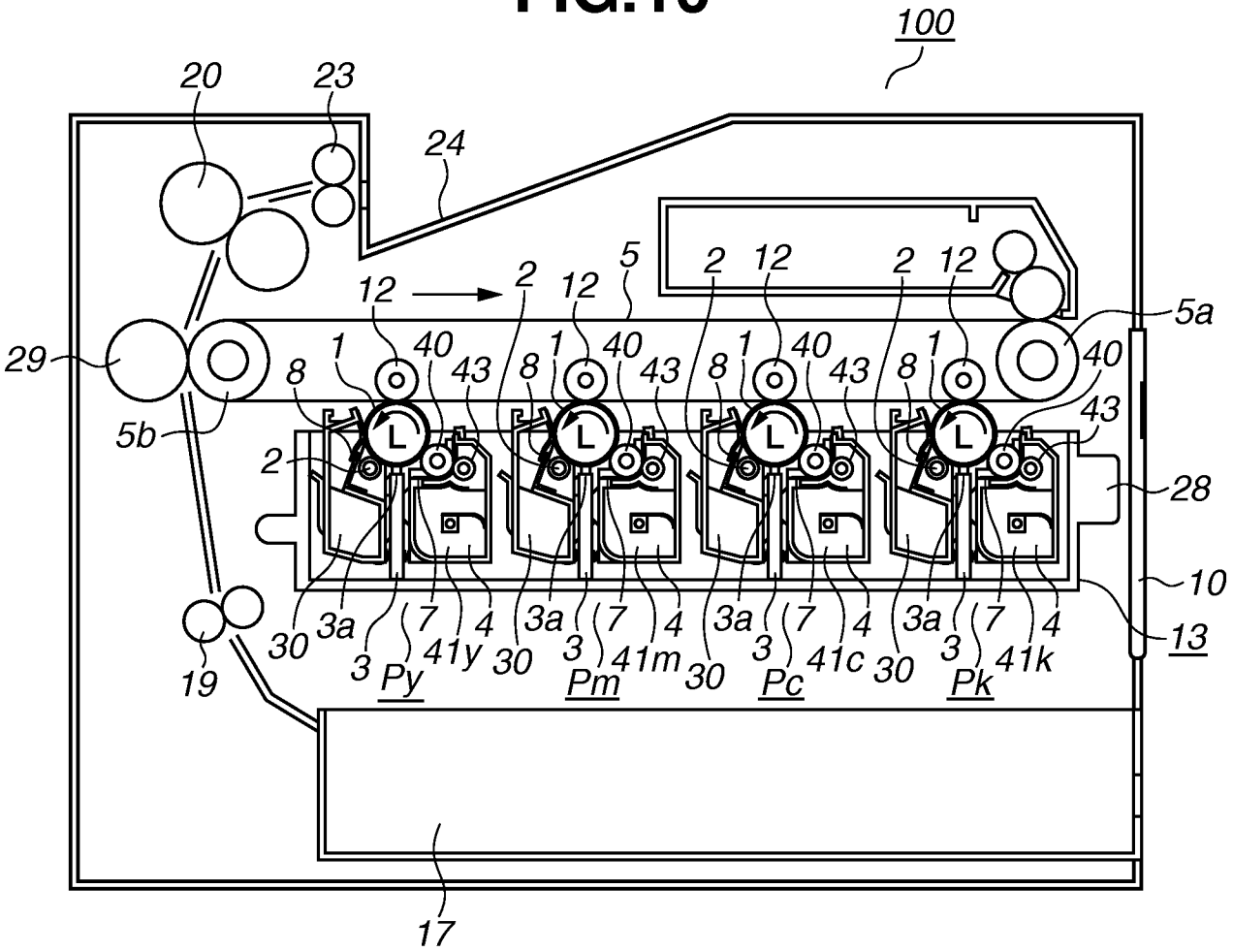
FIG. 10 is a schematic cross-sectional diagram illustrating an image-forming apparatus.
Figure 11:
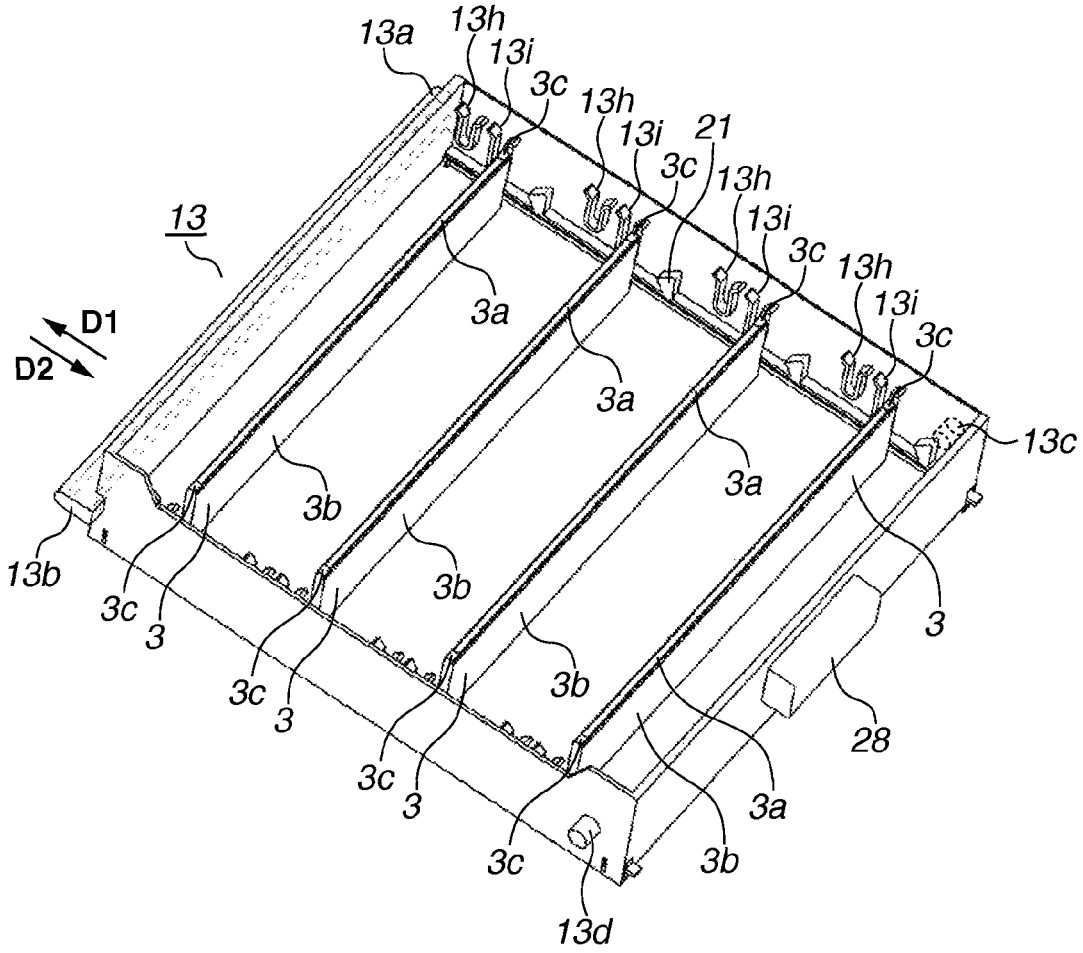
FIG. 11 is a perspective diagram illustrating a movable member of the image-forming apparatus.

An image-forming apparatus according to the second exemplary embodiment of the present invention will be described using FIGS. 10 and 11. FIG. 10 is a schematic cross-sectional diagram illustrating the image-forming apparatus, and FIG. 11 is a perspective diagram illustrating a movable member of the image-forming apparatus. An image-forming apparatus 100 according to the present exemplary embodiment is a four-color (full-color) LED printer using an electrophotographic process, and forms a full-color image on a recording medium, based on an input signal from an external device. As illustrated in FIG. 10, the image-forming apparatus 100 includes four photosensitive drums 1 serving as four image bearing members. The photosensitive drums 1 are arranged horizontally.

Further, the image-forming apparatus 100 includes, in addition to the photosensitive drum 1, components such as a charging roller 2 serving as a charging device, an exposure device 3, a developing unit 4, an electrostatic transfer unit 5, and a cleaning member 8, as an electrophotographic image forming process unit. The photosensitive drum 1, the charging roller 2, the developing unit 4, and the cleaning member 8 are integrated to form each of process cartridges P (Py, Pm, Pc, and Pk).

Each of the four process cartridges P contains a developer of different colors, namely, yellow, magenta, cyan, and black. The process cartridge Py contains the yellow developer, the process cartridge Pm contains the magenta developer, the process cartridge Pc contains the cyan developer, and the process cartridge Pk contains the black developer.

The photosensitive drum 1 is, for example, an aluminum cylinder having an outer peripheral surface to which an OPC layer is applied. The photosensitive drum 1 rotates in an arrow L direction in FIG. 10, by receiving a driving force from an apparatus main body. In the following description, an axial direction of the photosensitive drum 1 will be referred to as "longitudinal direction".

The charging roller 2 has a function of uniformly charging a surface of the photosensitive drum 1. The charging roller 2 is a conductive rubber roller, and abuts the surface of the photosensitive drum 1. According to the present exemplary embodiment, the photosensitive drum 1 is charged by using a contact charging method, but a non-contact charging method (e.g., corona charging) can be used.

The exposure device 3 is configured of an LED unit including an LED head 3*a*, an LED support member 3*b*, and a gap retaining portion 3*c*, as illustrated in FIG. 11. The LED head 3*a* is disposed in proximity to the photosensitive drum 1, to face a lower part of the photosensitive drum 1, and includes a plurality of LEDs disposed on a surface facing the photosensitive drum 1, as illustrated in FIG. 10. The LED support member 3*b* fixes and supports the LED head 3*a*, and the gap retaining portion 3*c* retains a gap between the photosensitive drum 1 and the LED head 3*a* in an attachment state of the process cartridge P (described in detail below). According to the present exemplary embodiment, the LED unit is taken as an example of the exposure device 3, but other types of component, such as an EL element, may be employed.

The developing unit 4 has a function of developing an electrostatic latent image formed on the surface of the photosensitive drum 1, by using the developer. The developing roller 40, which serves as a developer bearing member and bears the developer of the developing unit 4, is a conductive rubber roller. The developing roller 40 is disposed to face and to be in contact with the photosensitive drum 1.

A developer-supplying roller 43 and a developing blade 7 are provided to abut an outer periphery of the developing roller 40. The developer-supplying roller 43 is a sponge roller, and intrudes on the developing roller 40 to a certain degree. The developer-supplying roller 43 supplies the developer to the developing roller 40, at an abutment portion where the developing roller 40 and the developer-supplying roller 43 abut each other. The developing blade 7 is a metal sheet, a metal sheet to which urethane rubber is affixed, or a metal sheet coated with resin. The developing blade 7 has a function of regulating a film thickness of the developer on the developing roller 40, and causing friction charging of the developer at the abutment portion between the developing roller 40 and the developer-supplying roller 43.

Further, the developing units 4 include developer containers 41*y*, 41*m*, 41*c*, and 41*k*, respectively. The developer containers 41*y*, 41*m*, 41*c*, and 41*k* containing the yellow, magenta, cyan, and black developers, respectively.

The electrostatic transfer unit 5 has a function of transferring a developer image on the photosensitive drum 1 to a sheet material serving as a recording medium that is a material on which an image is to be transferred. Specific examples of the sheet material may include paper, an OHP sheet, and cloth. The electrostatic transfer unit 5 is driven to rotate at a speed corresponding to a speed of the photosensitive drum 1 in an arrow M direction illustrated in FIG. 10. The electrostatic transfer unit 5 is a dielectric endless belt having flexibility, and held around a drive roller 5*a* and an opposing roller 5*b* for secondary-transfer, while being stretched between them. The endless belt extends in a horizontal direction and the longitudinal direction.

The cleaning member 8 removes a residual developer on the surface of the photosensitive drum 1 after the transfer.

(Operation of forming Full-Color Image)

An operation of forming a full-color image will be described. The photosensitive drum 1 of the process cartridge P is driven to rotate at a predetermined control speed. The charging roller 2 rotates by following the photosensitive drum 1. As a result, the developing roller 40 and developer-supplying roller 43 are driven to rotate. In synchronization with the driving of the photosensitive drum 1, a charging bias is applied to each of the charging rollers 2 in a predetermined control timing. As a result, the surface of the photosensitive drum 1 is uniformly charged at predetermined polarity and potential.

The exposure member 3 exposes the surface of the photosensitive drum 1 to information light according to an image signal of each of yellow, magenta, cyan, and black colors. As a result, an electrostatic latent image according to the image signal corresponding to each color is formed on the surface of each of the photosensitive drums 1.

A developing bias is applied to the developing roller 40 in a predetermined control timing. As a result, the electrostatic latent image formed on the surface of each of the photosensitive drums 1 is developed by the developer on the developing roller 40, as a developer image. By this sequential operation, for example, a yellow developer image corresponding to a yellow component of a full-color image is formed on the photosensitive drum 1 of the process cartridge Py.

Then, the developer image is subjected to primary transfer onto the electrostatic transfer unit 5, at a primary transfer nip portion that is an abutment portion between the photosensitive drum 1 and the electrostatic transfer unit 5. A primary transfer roller 12 is in pressure contact with the photosensitive drum 1, with the electrostatic transfer unit 5 interposed therebetween. This forms the primary transfer nip portion. Likewise, a magenta developer image, a cyan developer image, and a black developer image are subjected to the primary transfer, in the process cartridge Pm, the process cartridge Pc, and the process cartridge Pk, respectively.

In this way, a full-color yet-to-be-fixed developer image of four colors of yellow, magenta, cyan, and black is formed by combining the respective developer images, on the electrostatic transfer unit 5. A color order of sequentially transferring the developer images for superimposition onto the electrostatic transfer unit 5 is not limited to the order described above.

The cleaning member 8 removes the residual developer on the photosensitive drum 1 after the primary transfer, and the removed residual developer is sent to a residual developer container 30.

Meanwhile, sheet materials stacked and stored in a feeding cassette 17 are each fed in a predetermined control timing. A registration roller pair 19 then guides the fed sheet material to a secondary transfer nip portion that is an abutment portion between the electrostatic transfer unit 5 and a secondary transfer roller 29, in a predetermined control timing.

A secondary transfer bias is applied to the secondary transfer roller 29 in a predetermined control timing. According to the present exemplary embodiment, a charging polarity of the secondary transfer bias is set to be opposite to the polarity of the developer. In a process in which the sheet material is conveyed while being pinched at the secondary transfer nip portion, a four-color superimposed developer image on the electrostatic transfer unit 5 is subjected to secondary transfer to the sheet material.

After passing through the secondary transfer nip portion, the sheet material is separated from a surface of the electrostatic transfer unit 5, and then guided to a fixing device 20 to be pressurized and heated at a fixing nip portion. Accordingly, each color of the developer image is mixed, and the resultant developer image is fixed to the sheet material. The sheet material then leaves the fixing device 20 to be discharged onto a discharge tray 24 by a discharge roller pair 23, as a full-color-image-formed object. This completes the operation of forming the full-color image.

According to the present exemplary embodiment, a shift mechanism (not illustrated) allows the secondary transfer roller 29 to move (be displaced) between an image-forming position where the secondary transfer nip portion is formed by abutment between the secondary transfer roller 29 and the electrostatic transfer unit 5, and a non-image-forming position where the secondary transfer roller 29 is away and not to be in contact with the electrostatic transfer unit 5. According to the present exemplary embodiment, the secondary transfer roller 29 moves to the image-forming position in an image-forming operation period of the image-forming apparatus 100, and moves to the non-image-forming position in a non-image-forming period. The secondary transfer roller 29 can also be configured to keep abutting the electrostatic transfer unit 5.

Further, according to the present exemplary embodiment, the electrostatic transfer unit 5 is disposed above the photosensitive drum 1, and the exposure device 3 is disposed below the photosensitive drum 1. In such a configuration, the full-color yet-to-be-fixed developer image of four colors of yellow, magenta, cyan, and black can be transferred to a sheet material via the secondary transfer roller 29, upon being formed on the electrostatic transfer unit 5. Therefore, the image forming operation of a first sheet can be completed in a short time, which is advantageous.

(Movable Member 13)

Figure 12:
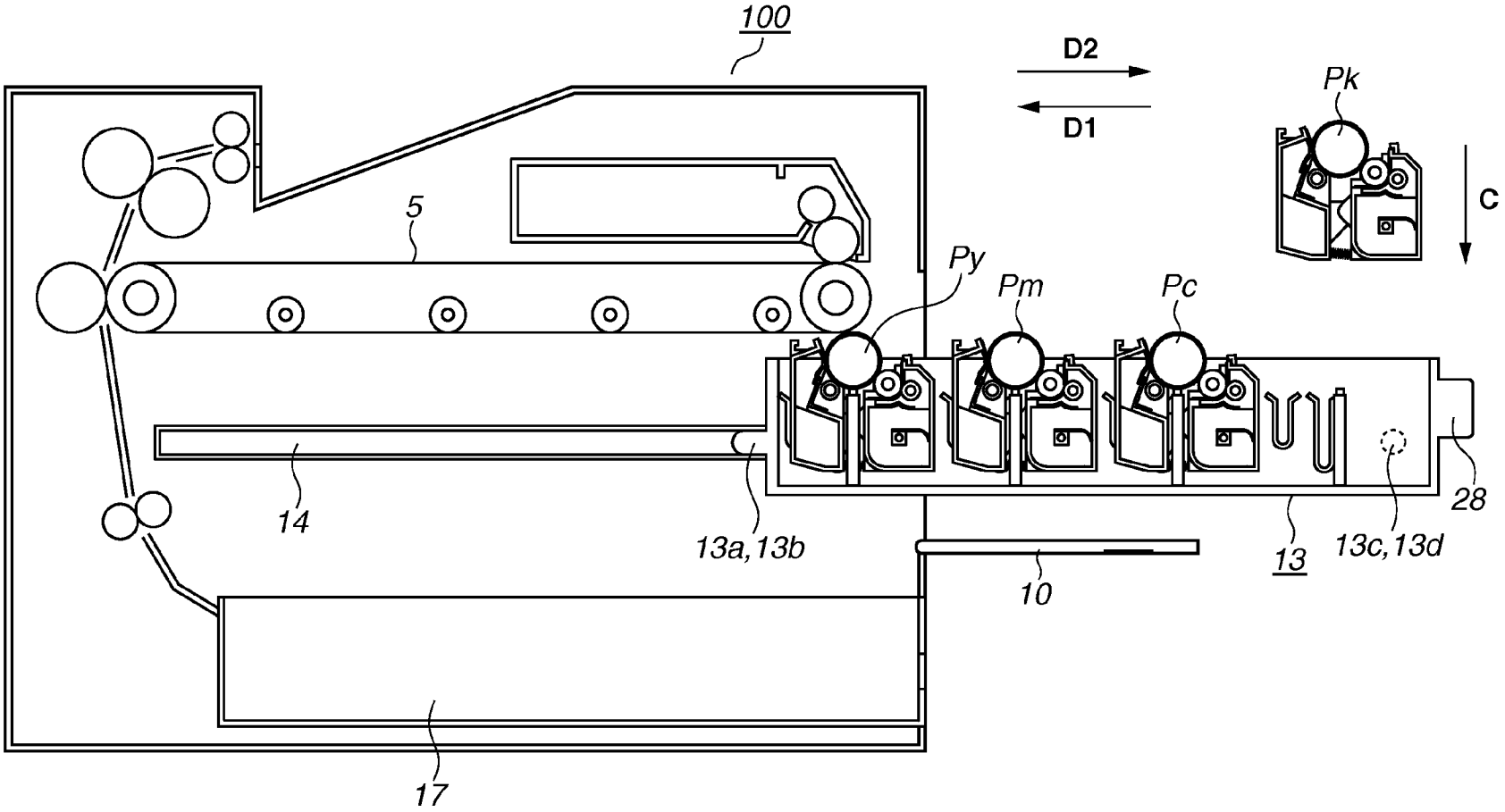
FIG. 12 is a schematic cross-sectional diagram illustrating a state where the movable member is drawn from the image-forming apparatus.

Moving operation of a movable member 13 will be described using FIGS. 10 to 12. FIG. 10 is a schematic cross-sectional diagram illustrating the image-forming apparatus 100. FIG. 11 is a perspective diagram illustrating the movable member 13 of the image-forming apparatus 100. FIG. 12 is a schematic cross-sectional diagram illustrating a state where the movable member 13 is drawn from the image-forming apparatus 100.

The movable member 13 is a support member on which the process cartridge P is mounted. The movable member 13 is movable between the image-forming position (an inside position) located on an inner side (inside) of the apparatus main body, and an attachment/detachment position (an outside position) located on an outer side (outside) of the apparatus main body for attaching/detaching the process cartridge P. According to the present exemplary embodiment, the apparatus main body corresponds to various members of the image-forming apparatus 100, except at least the movable member 13 and members configured to be fixed to or attachable to/detachable from the movable member 13.

As illustrated in FIG. 12, the movable member 13 is provided to be movable in a horizontal direction (an arrow D1 direction and an arrow D2 direction) relative to the apparatus main body. The movable member 13 is movable between a state of being stored in the apparatus main body illustrated in FIG. 10 (hereinafter referred to as "inside position") and a state of being drawn out of the apparatus main body illustrated in FIG. 12 (hereinafter referred to as "outside position"). In the following description, in a moving direction (the arrow D1 direction in FIG. 12) of the movable member 13 moved by a user from the outside position to the inside position, an upstream side (the right side in FIG. 12) is referred to as "frontward side" and a downstream side (the left side in FIG. 12) is referred to as "rearward side".

When the movable member 13 is at the outside position, the user can attach the process cartridge P (Py, Pm, Pc, and Pk) to the movable member 13. The attachment direction of the process cartridge P in this process is a gravitational direction (an arrow C direction in FIG. 12). The moving direction of the movable member 13 being attached is orthogonal to the longitudinal direction (the axial direction) of the process cartridge P.

When attached to the movable member 13, the process cartridge P is accommodated in the apparatus main body, together with the movable member 13. The door 10 is then closed, so that the process cartridge P is positioned at a predetermined location in the apparatus main body.

In this way, with the image-forming apparatus 100 according to the present exemplary embodiment, the four process cartridges P can be collectively inserted into the apparatus main body, and can be collectively drawn out of the apparatus main body. Therefore, workability in replacement of the process cartridge P is superior to a case where a configuration of individually attaching cartridges to an apparatus main body is adopted.

At four corners of the movable member 13, guided portions 13*a*, 13*b*, 13*c*, and 13*d* are provided as illustrated in FIG. 11. The guided portions 13*a*, 13*b*, 13*c*, and 13*d* are to be guided by a guide portion 14 of the apparatus main body illustrated in FIG. 12. The guided portions 13*a* and 13*b* each have a shape protruding from a side surface of the movable member 13, and extending in the moving direction (arrow D1 direction and arrow D2 direction in FIG. 11). On the other hand, the guided portions 13*c* and 13*d* each have a cylindrical shape protruding from the side surface of the movable member 13. The guided portions 13*a* and 13*b* are not cylindrical, to prevent the movable member 13 from tilting when the movable member 13 is at the outside position.

As illustrated in FIG. 11, on the frontward side of the movable member 13, a grip portion 28 is provided for an operation of the movable member 13 by the user. Further, the exposure device 3 corresponding to each of the process cartridges P is disposed in the longitudinal direction, in the movable member 13. Furthermore, cartridge guide portions 13*h* and 13*i* are provided in the movable member 13. When each of the process cartridges P is attached to the inside of the movable member 13, the cartridge guide portions 13*h* and 13*i* guide the process cartridge P to the attachment position.

FIG. 11 illustrates only the cartridge guide portions 13*h* and 13*i* at one end in the longitudinal direction. However, cartridge guide portions 13*h* and 13*i* (not illustrated) each having a shape similar to the shape described above are also provided at the other end.

Further, the movable member 13 has a release member 21 as illustrated in FIG. 11. The release member 21 at one end in the longitudinal direction is only illustrated in FIG. 11, as with the guide portions 13*h* and 13*i*. However, a release member 21 (not illustrated) having a shape similar to the shape of the release member 21 is also provided at the other end. An operation of the release member 21 will be described in detail below.

(Process Cartridge P)

Figure 13:
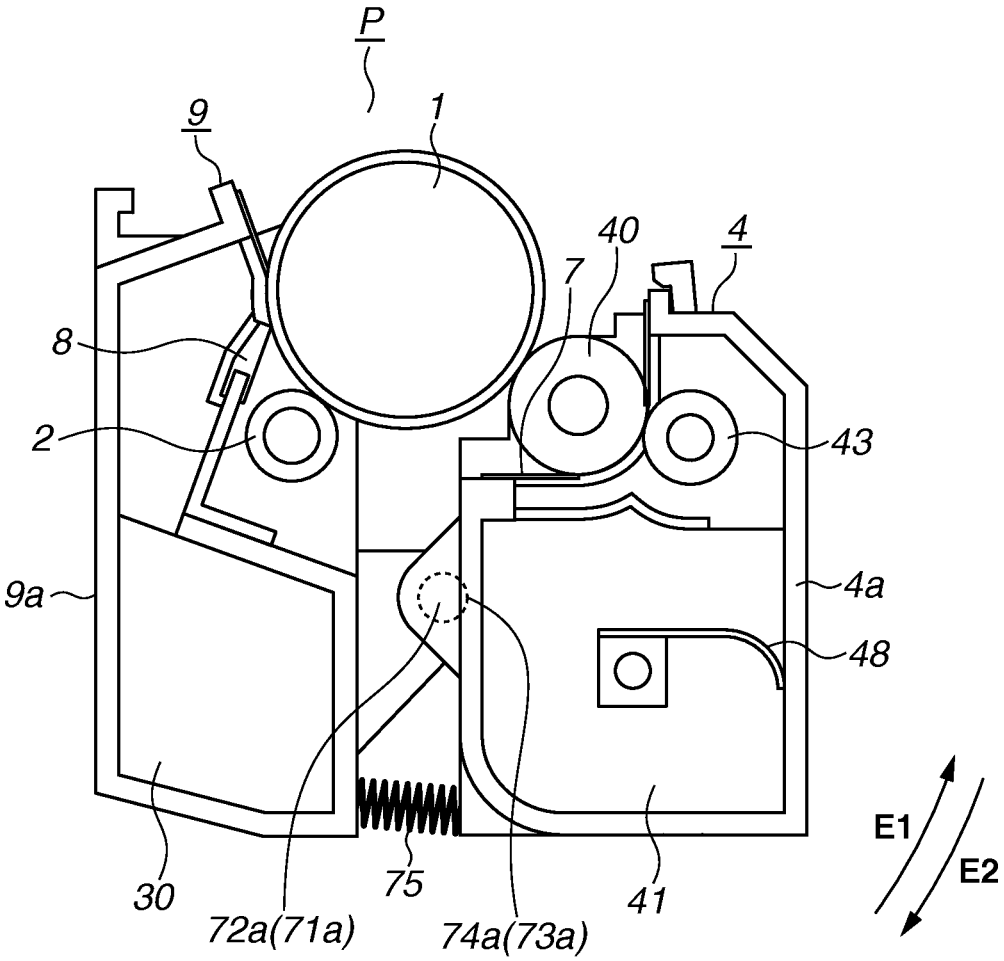
FIG. 13 is a cross-sectional diagram illustrating the process cartridge.
Figure 14:
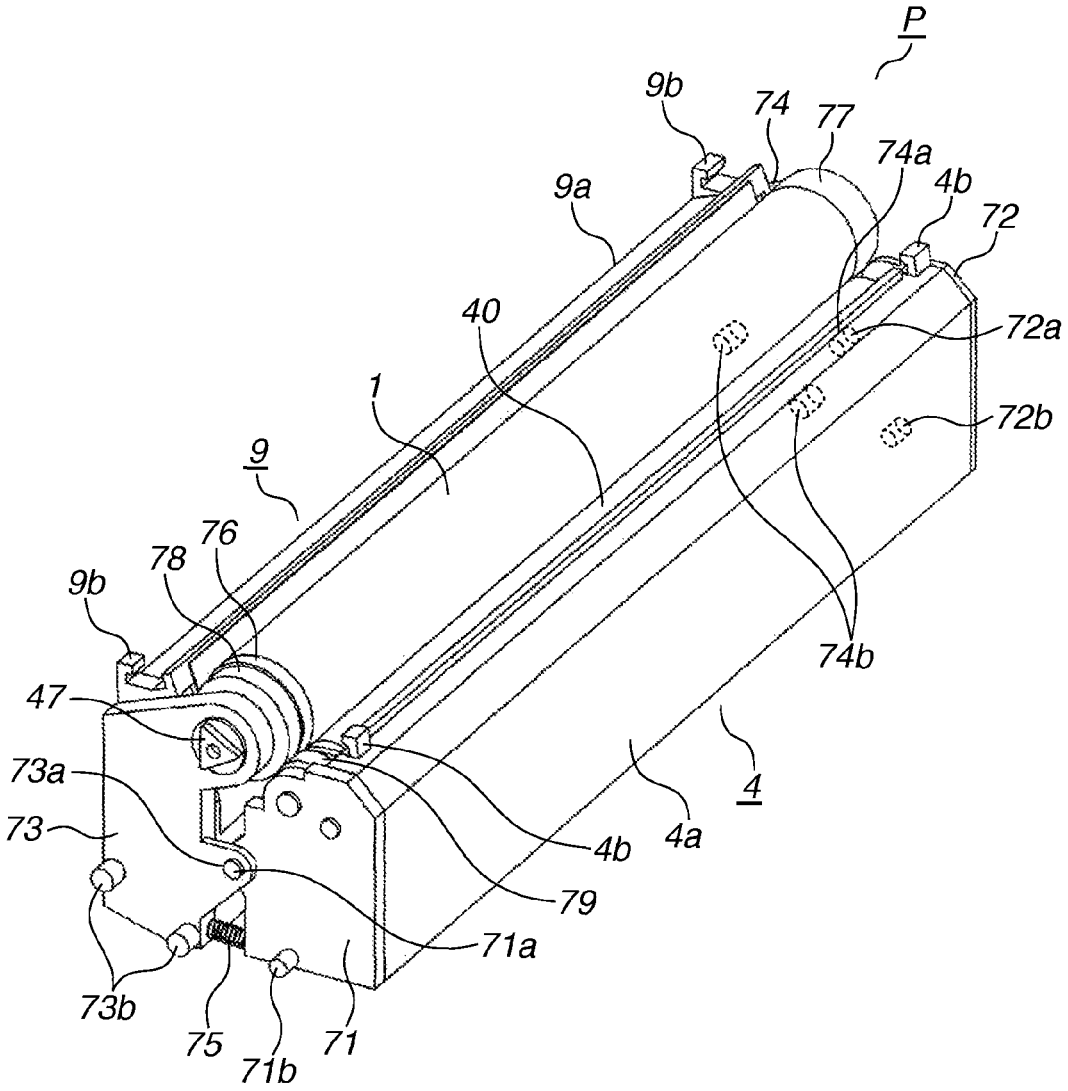
FIG. 14 is a perspective diagram illustrating the process cartridge.
Figure 15:
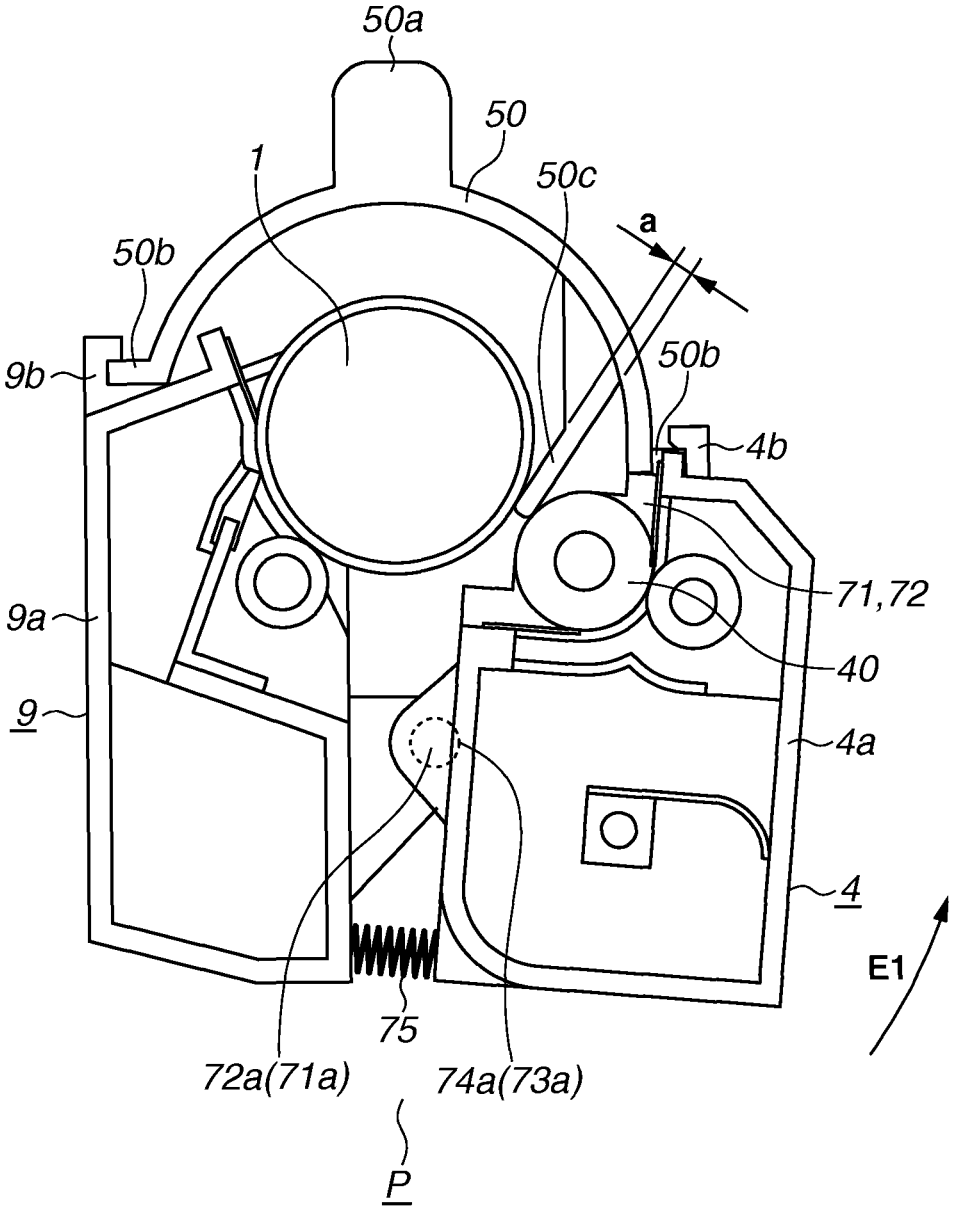
FIG. 15 is a cross-sectional diagram illustrating a state where a photosensitive member protection member is provided to the process cartridge.
Figure 16:
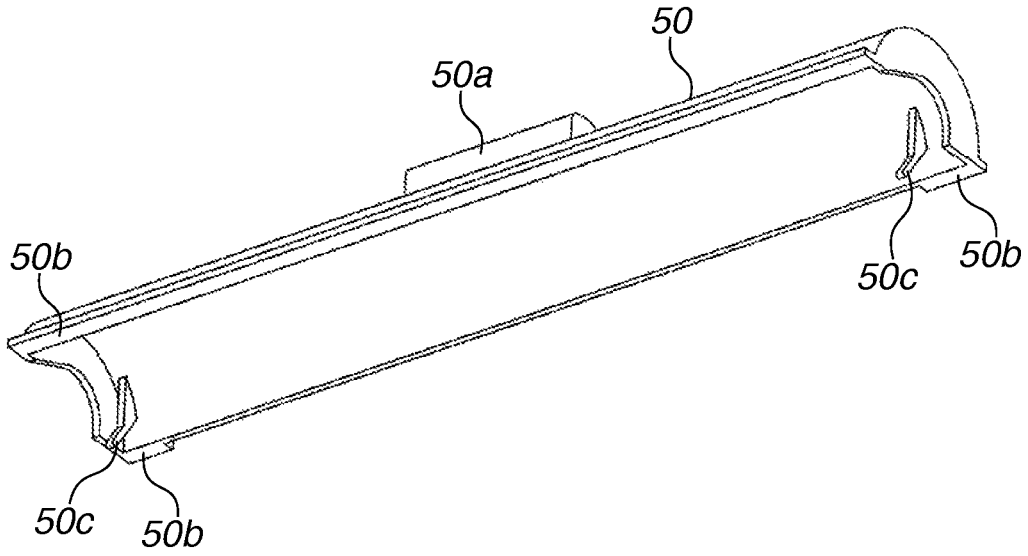
FIG. 16 is a perspective diagram illustrating the photosensitive member protection member.

The process cartridge P to be attached to the movable member 13 will be described using FIGS. 13 to 16. FIG. 13 is a cross-sectional diagram illustrating the process cartridge P. FIG. 14 is a perspective diagram illustrating the process cartridge P. FIG. 15 is a cross-sectional diagram illustrating a state where a photosensitive member protection member 50 serving as a protection member is secured to the process cartridge P. FIG. 16 is a perspective diagram illustrating the photosensitive member protection member 50. The process cartridge P includes a photosensitive member unit 9 serving as an image bearing member unit, and the developing unit 4 serving as a developer bearing member unit, as illustrated in FIG. 13.

In FIG. 13, the photosensitive member unit 9 includes the photosensitive drum 1, a photosensitive member frame 9*a*, the charging roller 2, the cleaning member 8, and the residual developer container 30. The photosensitive drum 1 is rotatably supported by the photosensitive member frame 9*a*.

As illustrated in FIG. 14, a coupling member 47 and a photosensitive member gear 78 are provided at one end of the process cartridge P in the longitudinal direction, to receive a driving force from the apparatus main body. The driving force received by the coupling member 47 is transmitted from the photosensitive member gear 78 to other drive gear (not illustrated) via a development gear 79 of the developing unit 4. As a result, a developing roller 40, and the developer-supplying roller 43, and a conveyance member 48 are driven to rotate.

Further, a photosensitive-member-unit driving-side side cover 73 and a photosensitive-member-unit driven-side side cover 74 are provided at both ends of the photosensitive member unit 9 in the longitudinal direction, respectively. The photosensitive-member-unit driving-side side cover 73 and the photosensitive-member-unit driven-side side cover 74 have aperture portions 73*a* and 74*a*, respectively, in which engagement portions 71*a* and 72*a* illustrated in FIG. 14 of the developing unit 4 are engaged, respectively.

Furthermore, the photosensitive-member-unit driving-side side cover 73 and the photosensitive-member-unit driven-side side cover 74 have a cartridge guided portion pair 73*b* and a cartridge guided portion pair 74*b* illustrated in FIG. 14, respectively. Each of the cartridge guided portion pairs 73*b* and 74*b* corresponds to the cartridge guide portions 13*h* and 13*i* of the movable member 13 described above. In attachment of the process cartridge P to the movable member 13, each of the cartridge guided portion pairs 73*b* and 74*b* engages with the cartridge guide portions 13*h* and 13*i*, so that the process cartridge P is guided to the attachment position.

Further, gap retaining members 77 and 76 illustrated in FIG. 14 are disposed on the same axis as the photosensitive drum 1. The gap retaining portion 3*c* described above, which is illustrated in FIG. 11, of the exposure device 3 abuts the gap retaining members 77 and 76 illustrated in FIG. 14, so that a fixed gap can be retained between the photosensitive drum 1 and the LED head 3*a*.

As illustrated in FIG. 13, the developing unit 4 includes the developing roller 40, a developing frame 4*a*, the developer-supplying roller 43, the developing blade 7, a developer container 41, and the conveyance member 48. The developing roller 40 is rotatably supported by the developing frame 4*a*. The conveyance member 48 conveys the developer in the developer container 41, to the developing roller 40. Further, a developing-unit driving-side side cover 71 and a developing-unit driven-side side cover 72 are provided at both ends of the developing unit 4 in the longitudinal direction, respectively, as illustrated in FIG. 14. The developing-unit driving-side side cover 71 and the developing-unit driven-side side cover 72 have the above-described engagement portions 71*a* and 72*a* of the developing unit 4, respectively.

(Coupling Between Photosensitive Member Unit 9 and Developing Unit 4)

Coupling between the photosensitive member unit 9 and the developing unit 4 will be described. As illustrated in FIG. 14, the engagement portions 71*a* and 72*a* of the developing unit 4 are engaged in the aperture portions 73*a* and 74*a* of the photosensitive member unit 9, respectively, so that the photosensitive member unit 9 and the developing unit 4 are coupled to each other. The engagement portions 71*a* and 72*a* are rotatably supported in the aperture portions 73*a* and 74*a*.

Therefore, as illustrated in FIG. 13, the developing unit 4 is supported to be swingable in an arrow E1 direction and an arrow E2 direction illustrated in FIG. 13, about the engagement portions 71*a* and 72*a*, relative to the photosensitive member unit 9. Further, a spring 75 serving as an urging member is disposed between the photosensitive member unit 9 and the developing unit 4. The spring 75 is provided to press the developing roller 40 against the photosensitive drum 1 with a predetermined pressure.

(Separation and Abutment Between Photosensitive Member Unit 9 and Developing Unit 4)

Figure 18A:
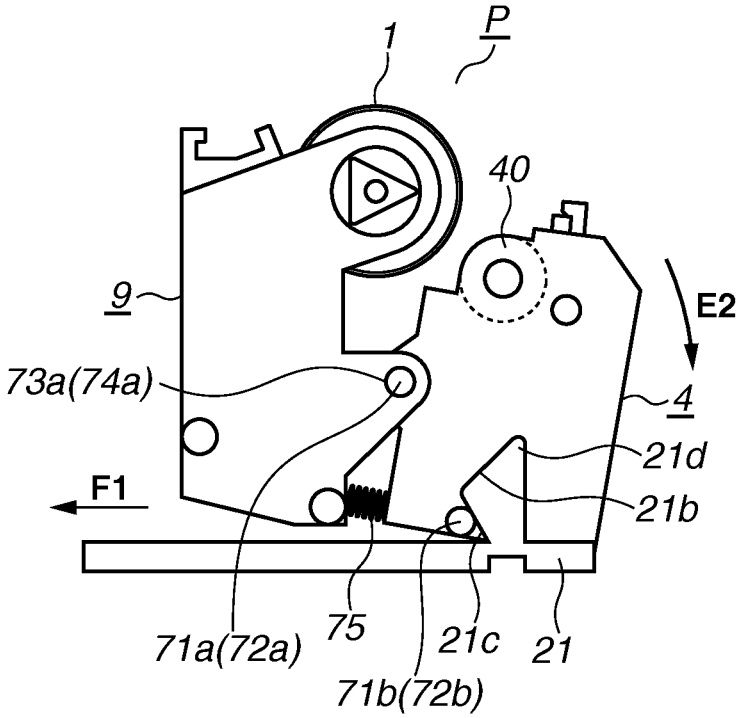
FIGS. 18A and 18B are cross-sectional diagrams each illustrating an operation of the release member.

According to the present exemplary embodiment, when the movable member 13 to which the process cartridge P is attached is at the inside position, the photosensitive member unit 9 and the developing unit 4 are in either of two positions, namely, a "separation position" and a "contact position". Specifically, the "separation position" is a position in which the developing roller 40 is away (separated) from the photosensitive drum 1 as illustrated in FIG. 18A. On the other hand, the "contact position" is a position in which the developing roller 40 is in contact with the photosensitive drum 1. One reason for providing the "separation position" and the "contact position" is that, if the photosensitive drum 1 and the developing roller 40 remain abutting each other for a long period of time, the developing roller 40 deforms at an abutment portion where the developing roller 40 abuts the photosensitive drum 1, which may adversely affect an image.

Figure 17A:
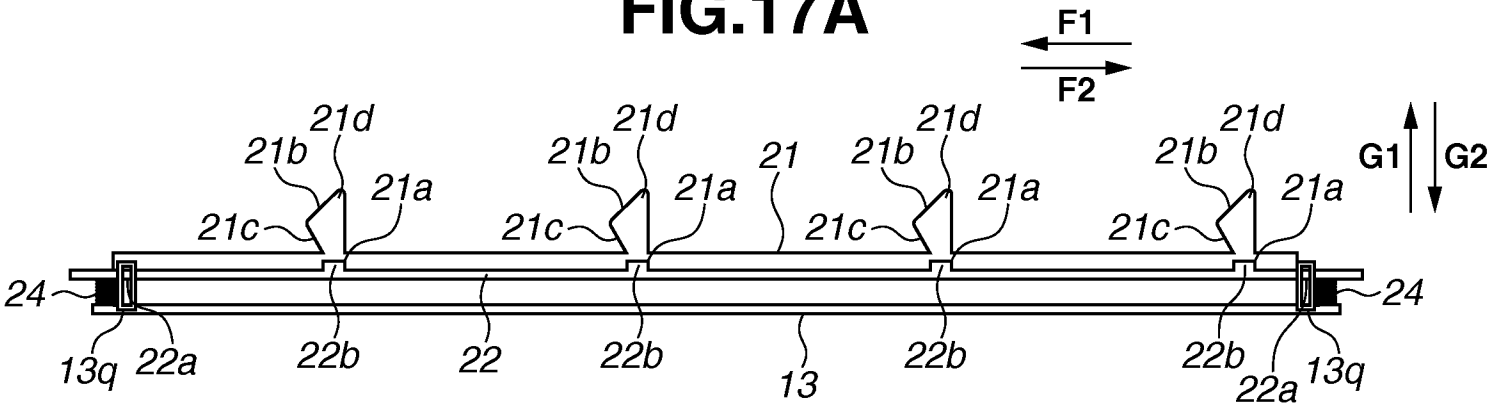
FIGS. 17A and 17B are schematic diagrams each illustrating a configuration of a release member.
Figure 17B:
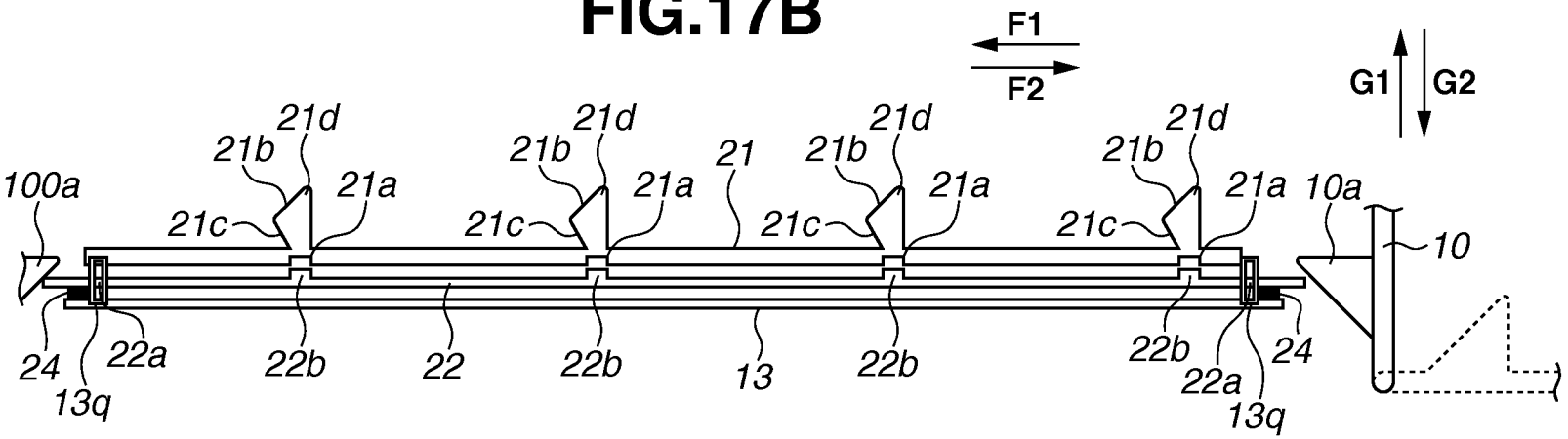
Figure 18B:
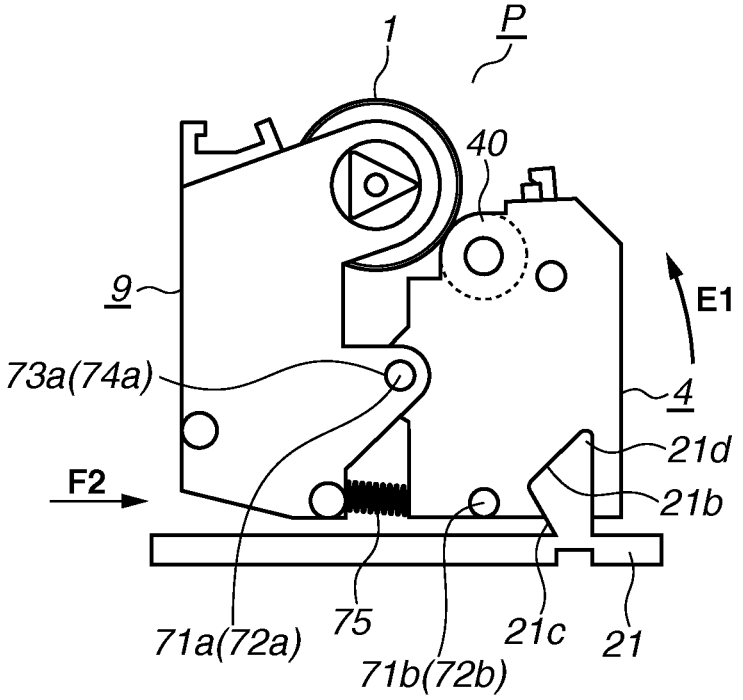

According to the present exemplary embodiment, the release member 21 is involved in the separation and the abutment between the photosensitive member unit 9 and the developing unit 4. In this regard, an operation of the release member 21 will be described using FIG. 14, FIGS. 17A and 17B, as well as FIGS. 18A and 18B. FIG. 14 is a perspective diagram illustrating the process cartridge P. FIGS. 17A and 17B are schematic diagrams each illustrating a configuration of the release member 21. FIGS. 18A and 18B are cross-sectional diagrams each illustrating the operation of the release member 21. In FIG. 17A, the movable member 13 is at the outside position located outside the apparatus main body. In FIG. 17B, the movable member 13 is at the inside position located inside the apparatus main body.

As illustrated in FIGS. 11 and 17A, the release member 21 has four releasing portions 21*d* at each of both ends of the movable member 13 in the longitudinal direction, corresponding to the four process cartridges P. On the other hand, the developing unit 4 of each of the process cartridges P has the released portions 71*b* and 72*b* at both ends in the longitudinal direction, as illustrated in FIG. 14.

When the movable member 13 to which the process cartridge P is attached is at the inside position, the release member 21 can move in a horizontal direction (an arrow F1 direction and an arrow F2 direction in FIGS. 17A and 17B). In the state where the process cartridge P is attached to the movable member 13, the release member 21 is in either of two positions, namely, a "separation position" and a "contact position" corresponding to the above-described "separation position" and "contact position".

As illustrated in FIG. 18A, the "separation position" is a position where the release member 21 moves in an arrow F1 direction in FIG. 18A, and the releasing portion 21*d* press the released portions 71*b* and 72*b* of the developing unit 4. Upon a press of the released portions 71*b* and 72*b* by the releasing portion 21*d*, a torque around the engagement portions 71*a* and 72*a* acts on the developing unit 4 in an arrow E2 direction in FIG. 18A. The developing roller 40 is thus separated from the photosensitive drum 1.

Further, as illustrated in FIG. 18B, the "contact position" is a position where the release member 21 moves in an arrow F2 direction in FIG. 18B, and the releasing portion 21*d* leaves the released portions 71*b* and 72*b*. When the releasing portion 21*d* is away from the released portions 71*b* and 72*b* by shifting from the "separation position", an urging force of the spring 75 acts. Then, a torque on the developing unit 4 acts in an arrow E1 direction. As a result, the developing roller 40 abuts the photosensitive drum 1.

A case where the movable member 13 is at the outside position located outside the apparatus main body will be described. As illustrated in FIG. 17A, a lock member 22 is disposed on an undersurface of the release member 21. The lock member 22 has a guide axis 22*a* to be engaged in a first guide groove 13*q* provided in the movable member 13. The first guide groove 13*q* extends in the vertical direction (an arrow-G1 direction and an arrow G2 direction in FIGS. 17A and 17B) and therefore, the lock member 22 is movable in the vertical direction. Further, the lock member 22 is restricted to move in the horizontal direction (the arrow F1 direction and the arrow F2 direction in FIGS. 17A and 17B), because, the first guide groove 13*q* and the guide axis 22*a* engage with each other with a fitting tolerance in the horizontal direction.

Further, the lock member 22 includes a lock portion 22*b*. The lock portion 22*b* engages with a locked portion 21*a* of the release member 21. As described above, the lock member 22 is movable in the vertical direction (the arrow G1 direction and the arrow G2 direction in FIGS. 17A and 17B). Therefore, the lock portion 22*b* and the locked portion 21*a* engage with each other, when movement of the lock member 22 in the arrow G1 direction (upward) in FIGS. 17A and 17B is completed. In this process, the release member 21 is restricted to move (prevented from moving) in the horizontal direction by the lock member 22. This position will be referred to as a "lock position" in the following.

When the movable member 13 is at the outside position located outside the apparatus main body, the lock member 22 is urged by a lock spring 24 in the arrow G1 direction, as illustrated in FIG. 17A. This keeps the release member 21 in the lock position.

Next, a case where the movable member 13 is at the inside position of the apparatus main body will be described. Upon completion of movement of the lock member 22 in the arrow G2 direction (downward) in FIGS. 17A and 17B, the lock portion 22*b* and the locked portion 21*a* do not engage with each other, as illustrated in FIG. 17B. In other words, in this state, the release member 21 is movable in the horizontal direction (the arrow F1 direction and the arrow F2 direction in FIGS. 17A and 17B). This position will be referred to as a "non-lock position" in the following.

When the movable member 13 is inserted into the apparatus main body, and then the door 10 is closed, a first pressing portion 10*a* of the door 10 and a second pressing portion 100*a* in the apparatus main body press the lock member 22. As a result, the lock member 22 moves in the arrow G2 direction in FIG. 17B, to be in the "non-lock position".

With such a configuration, the release member 21 is regulated to move in the horizontal direction (the arrow F1 direction and the arrow F2 direction in FIGS. 17A and 17B), when the movable member 13 is at the outside position. Further, when the movable member 13 is at the inside position, the release member 21 is movable in the horizontal direction (the arrow F1 direction and the arrow F2 direction in FIGS. 17A and 17B), thereby allowing the process cartridge P to move from the contact position to the separation position described above. In other words, when the release member 21 moves in the horizontal direction relative to the movable member 13 in the state where the movable member 13 is at the inside position (image-forming position), a change occurs in a separation distance between the developing roller 40 and the photosensitive drum 1.

The reason why the release member 21 is restricted to move in the horizontal direction when the movable member 13 is at the outside position will be described below.

(Photosensitive Member Protection Member and Securing Thereof)

The photosensitive member protection member 50 and securing thereof will be described. As illustrated in FIG. 15, the photosensitive member protection member 50 is provided on a top surface of the process cartridge P provided as a new cartridge, to cover the entire exposed part of the photosensitive drum 1 in the longitudinal direction. This is to protect the surface of the photosensitive drum 1. The user can attach the process cartridge P to the movable member 13, by gripping a grip portion 50*a* of the photosensitive member protection member 50. On the photosensitive member protection member 50, engaged portions 50*b* to be described below each engage with a first engaging portion 9*b* and a second engaging portion 4*b*. Therefore, the photosensitive member protection member 50 can stabilize the posture of the process cartridge P in a state of the grip portion 50*a* being gripped by the user. The first engaging portion 9*b* and the second engaging portion 4*b* each engage with the photosensitive member protection member 50 at different locations.

Upon completion of an operation of attaching the process cartridge P provided as a new cartridge, at least part of engagement between the process cartridge P and the photosensitive member protection member 50 is released, as will be described below. Therefore, the user can easily remove the photosensitive member protection member 50 from the process cartridge P.

As illustrated in FIG. 15, the photosensitive member protection member 50 has the engaged portions 50*b*. The engaged portions 50*b* each engage with the first engaging portion 9*b* of the photosensitive member frame 9*a* and the second engaging portion 4*b* of the developing frame 4*a*. This prevents removal of the photosensitive member protection member 50 from the process cartridge P.

Further, as illustrated in FIG. 16, a nipped portion (a separation portion) 50*c* is provided at each of both ends of the photosensitive member protection member 50 in the longitudinal direction. As illustrated in FIG. 15, the nipped portion 50*c* is nipped between the photosensitive drum 1 and either one of the developing-unit driving-side side cover 71 and the developing-unit driven-side side cover 72, in a state of the photosensitive member protection member 50 being secured to the process cartridge P. The nipped portion 50*c* is the separation portion that separates the photosensitive drum 1 and the developing roller 40 from each other.

As described above, the developing unit 4 is supported to be rotatable relative to the photosensitive member unit 9, and the developing roller 40 is urged by the spring 75 in the direction (the arrow E1 direction in FIG. 15) of abutting the photosensitive drum 1. The urging force of the spring 75 acts in a direction of nipping the nipped portion 50*c* and therefore, removal of the process cartridge P from the photosensitive member protection member 50 can be reliably prevented.

Moreover, providing the nipped portion 50*c* forms a gap between the photosensitive drum 1 and the developing roller 40. Therefore, deformation of the developing roller 40 can be prevented. If the photosensitive drum 1 and the developing roller 40 remain abutting each other for a long period of time, the developing roller 40 deforms at the abutment portion where the developing roller 40 abuts the photosensitive drum 1, which may adversely affect an image.

Concerning the nipped portion 50*c* of the photosensitive member protection member 50, the state where the engaged portions 50*b* of the photosensitive member protection member 50 are each engaged with the first engaging portion 9*b* and the second engaging portion 4*b* is a "first position". The distance between the photosensitive drum 1 and the developing roller 40 in this state is referred to as a "separation distance a" illustrated in FIG. 15.

(Attachment of Process Cartridge P and Removal of Photosensitive Member Protection Member 50)

Figure 9A:
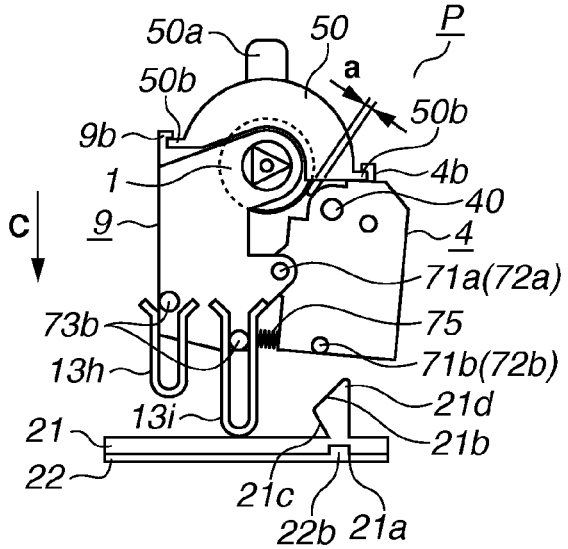
FIGS. 9A, 9B, and 9C are side views each illustrating the operation of attaching a process cartridge to a movable member.
Figure 9B:
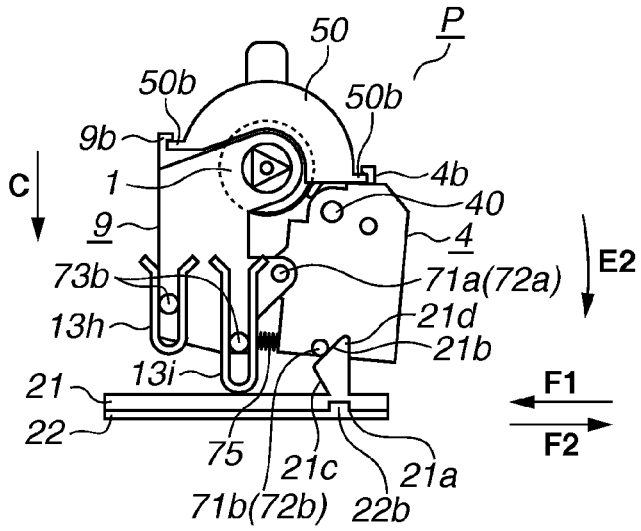
Figure 9C:
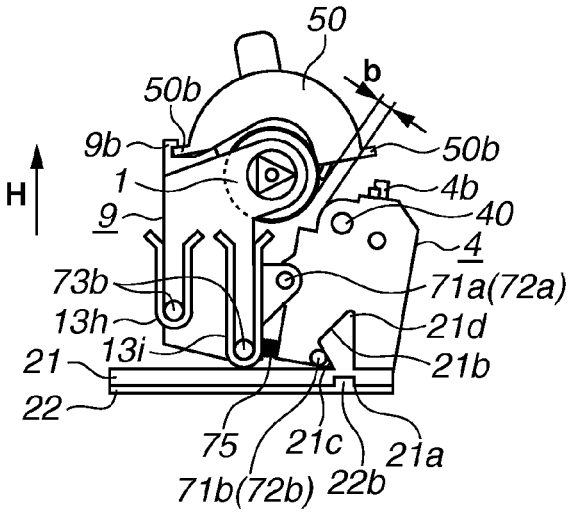

Attachment of the process cartridge P to the movable member 13 and removal of the photosensitive member protection member 50 will be described using FIGS. 9A, 9B, and 9C. FIGS. 9A, 9B, and 9C are side views each illustrating an operation of attaching the process cartridge P to the movable member 13. For easy understanding, FIGS. 9A, 9B, and 9C each only illustrate the cartridge guide portions 13*h* and 13*i*, the release member 21, and the lock member 22, instead of illustrating the entire movable member 13.

As illustrated in FIG. 9A, the user attaches the process cartridge P by moving the process cartridge P in an arrow C direction, in a state where the movable member 13 is at the outside position located outside the apparatus main body. The user then keeps moving the process cartridge P in the arrow C direction, so that the released portions 71*b* and 72*b* of the developing unit 4 each abut a corresponding slope 21*b* of the release member 21, to be pressed, as illustrated in FIG. 9B.

The slope 21*b* of the release member 21 has the following function. The slope 21*b* displaces the developing unit 4 relative to the photosensitive member unit 9, by coming into contact with the corresponding one of the released portions 71*b* and 72*b* provided as a part of the developing unit 4, in attachment of the process cartridge P to the movable member 13 located at the attachment/detachment position.

As the process cartridge P is moved in the arrow C direction in FIGS. 9A and 9B, the amount of a press on each of the released portions 71*b* and 72*b* by the slope 21*b* increases, so that a torque around the engagement portions 71*a* and 72*b* acts on the developing unit 4 in the arrow E2 direction in FIG. 9B. In other words, the developing unit 4 moves in a direction in which the developing roller 40 moves away from the photosensitive drum 1. When the developing unit 4 moves, the photosensitive member unit 9 is guided by the cartridge guide portions 13*h* and 13*i*. Therefore, a change in posture of the photosensitive member unit 9 is suppressed. The cartridge guide portions 13*h* and 13*i* serve as maintaining portions provided on the movable member 13 to maintain the posture of the photosensitive member unit 9 when the developing unit 4 moves.

As described above, when the movable member 13 is at the outside position, the release member 21 is regulated by the lock member 22 to move in the horizontal direction (an arrow F1 direction and an arrow F2 direction in FIG. 9B). Therefore, the release member 21 is prevented from moving in the direction (the arrow F2 direction in FIG. 9B) in which the release member 21 leaves each of the released portions 71*b* and 72*b*, even if the release member 21 receives a reaction force of the spring 75, when the developing unit 4 moves in the arrow E2 direction in FIG. 9B. In addition, the lock member 22 is prevented from moving in the arrow F2 direction, because the urging force of the lock spring 24 is set to be greater than the reaction force received by the release member 21 from the spring 75.

Upon completion of the operation of attaching the process cartridge P to the movable member 13, the released portions 71*b* and 72*b* each enter a state where the released portions 71*b* and 72*b* each abut a corresponding recess 21*c* of the release member 21, as illustrated in FIG. 9C. As will be described below, the recess 21*c* functions as a blocking portion provided to prevent the process cartridge P from being removed from the movable member 13 by the urging force of the spring 75.

In this state, the photosensitive drum 1 and the developing roller 40 are separated from each other at a separation distance b, and the engaged portion 50*b* of the photosensitive member protection member 50 is released from engagement with the second engaging portion 4*b*. In other words, when the process cartridge P is attached to the movable member 13, the photosensitive member protection member 50 releases the engagement with the process cartridge P, to be removable from the process cartridge P. According to the present exemplary embodiment, the photosensitive member protection member 50 releases the engagement with the second engaging portion 4*b* when the process cartridge P is attached to the movable member 13. However, the photosensitive member protection member 50 may release the engagement with the first engaging portion 9*b*.

In other words, if the photosensitive member protection member 50 engages with a plurality of engagement portions of the process cartridge P, this engagement may be partially released so that the photosensitive member protection member 50 becomes removable from the process cartridge P. According to the present exemplary embodiment (the second exemplary embodiment), the developing unit 4 corresponds to the engagement member (the connection member in FIGS. 8A to 8D) according to the first exemplary embodiment. In other words, in the process of being attached to the attachment portion of the movable member 13, the developing unit 4 abuts the release member 21 (the slope 21*b*) of the movable member 13, thereby shifting from an engagement position illustrated in FIG. 9A, to a release position illustrated in FIG. 9C. Therefore, the developing unit 4 changes from the state where the developing unit 4 engages with the photosensitive member protection member 50 as illustrated in FIG. 9A, to the state where this engagement is released as illustrated in FIG. 9C. In addition, the slope 21*b* of the release member 21 corresponds to the contact surface 15*a* illustrated in FIGS. 8A to 8D according to the first exemplary embodiment. The slope 21*b* is an abutment portion that abuts the developing unit 4 that is an engagement member.

When the process cartridge P is attached to the movable member 13, the released portions 71*b* and 72*b* are each caused to abut the corresponding recess 21*c* to prevent removal of the process cartridge P from the movable member 13. When the process cartridge P is attached to the movable member 13, the force of the spring 75 urging the developing roller 40 toward the photosensitive drum 1 is exerted to press the released portion 71*b* against the release member 21.

Without the recess 21*c*, the process cartridge P receives a force from the release member 21 (the reaction force of the spring 75) in a direction (an arrow H direction in FIG. 9A) of being removed from the movable member 13, due to a reaction pressing the release member 21 by each of the released portions 71*b* and 72*b*. However, according to the present exemplary embodiment, the recess 21*c* prevents removal of each of the released portions 71*b* and 72*b*, and therefore, the process cartridge P is prevented from being removed from the movable member 13.

In other words, the recess 21*c* is a blocking portion that prevents the process cartridge P attached to the movable member 13 from being removed from the movable member 13 by the urging force of the spring 75 (the urging member that urges the developing roller 40 toward the photosensitive drum 1).

When the process cartridge P is attached to the movable member 13, the engagement between the engaged portion 50*b* of the photosensitive member protection member 50 and at least one of the first engaging portion 9*b* and the second engaging portion 4*b* is released. This state is a "second position" (see FIG. 9C). A relationship between the separation distance "a", which is provided between the photosensitive drum 1 and the developing roller 40 in the first position (see FIG. 15) described above, and the separation distance "b" (see FIG. 9C) in the second position is a<b.

As described above, with the image-forming apparatus 100 according to the present exemplary embodiment, the photosensitive member protection member 50 is less likely to be removed from the process cartridge P, until immediately before the process cartridge P is attached to the image-forming apparatus 100. Therefore, the photosensitive drum 1 can be protected more reliably than conventional techniques.

The exemplary embodiments have been described above, but the present invention is not limited thereto, and may be variously modified within the scope of the gist thereof.

According to the exemplary embodiments described above, the photosensitive member protection member 50 can be removed by the operation of attaching the process cartridge P to the movable member 13. However, the present invention is not limited to this type of protection member, i.e., a protection member that protects a photosensitive member. The present invention is also applicable to a protection member that protects any other member removable from a process cartridge. For example, in a configuration in which a developing roller is exposed, a protection member may be configured to cover the developing roller.

In addition, in the exemplary embodiments described above, the electrostatic transfer unit 5 is taken as an example of the transfer member. However, the present invention is not limited to this example. For example, the present invention is applicable to a direct transfer member included in a configuration in which a sheet material serving as a material on which an image is to be transferred is conveyed to the surface of the photosensitive drum 1, and the direct transfer member directly transfers a developer image on the photosensitive drum 1 to the sheet material.

In the exemplary embodiments described above, when the process cartridge P is attached to the movable member 13, the slope 21*b* of the release member 21 allows the developing unit 4 to move relative to the photosensitive member unit 9 by coming into contact with the developing unit 4. However, it is conceivable to provide such a configuration that the release member 21 allows the photosensitive member unit 9 to move relative to the developing unit 4 by coming into contact with the photosensitive member unit 9, when the process cartridge P is attached to the movable member 13.

In other words, the developing unit 4 may only need to be displaced relative to the photosensitive member unit 9, to release the engagement between the photosensitive member protection member 50 and the process cartridge P. Therefore, the photosensitive member unit 9 may be moved (displaced) by the release member 21, in a state of the developing unit 4 being fixed to the movable member 13.

However, it is desirable to precisely position a photosensitive drum on which a toner image is to be formed, in the inside of an image-forming apparatus. Considering this point, it is preferable to fix the photosensitive member unit 9, and to move the developing unit 4 relative to the movable member 13, as described above in the exemplary embodiment described above.

The effects of the exemplary embodiments (first and second exemplary embodiments) described above in the present application are as follows. According to the configuration of each of the exemplary embodiments, in the configuration in which the cartridge includes the protection member, the cartridge can be readily removed by attaching the cartridge to the attachment portion of the movable member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-096599, filed May 8, 2014, No. 2014-168328, filed Aug. 21, 2014, and No. 2015-055899, filed Mar. 19, 2015 which are hereby incorporated by reference herein in their entirety.

What is claimed is:

1. An image-forming apparatus for forming an image on a recording medium, the image-forming apparatus comprising:

an apparatus main body;

a cartridge to which a protection member is detachably attached, wherein the protection member protects the cartridge in a state being attached to the cartridge, a movable member, including an attachment portion for attachment of the cartridge, configured to be movable relative to the apparatus main body in a state such that the cartridge is attached to the attachment portion, the movable member being able to be in an inside position located inside the apparatus main body where the cartridge is in a state such that image forming is executable, and in an outside position located outside the apparatus main body where the cartridge is in a state of being attachable to and detachable from the attachment portion;

an engagement member, provided in the cartridge, configured to be movable to an engagement position where an engagement state of the protection member with the cartridge is secured by the engagement member engaging with the protection member, and to a release position where engagement between the protection member and the engagement member is released and removal of the protection member from the cartridge is allowed; and a release member configured to move the engagement member from the engagement position to the release position by abutting the engagement member, when the cartridge is attached to the attachment portion, wherein the image forming apparatus is capable of executing an image forming in a state that the cartridge removed with the protection member is mounted on the movable member and the movable member is located at the inside position.

2. The image-forming apparatus according to claim 1, wherein the release member is provided in the movable member.

3. The image-forming apparatus according to claim 1, wherein the cartridge includes an image bearing member that bears an image, and wherein the protection member covers an exposed part of the image bearing member.

4. The image-forming apparatus according to claim 3, wherein the image bearing member is disposed upstream of the cartridge in an attachment direction of attaching the cartridge to the attachment portion.

5. The image-forming apparatus according to claim 1, wherein the cartridge includes:

an image bearing member unit including an image bearing member that bears an image, and a developer bearing member unit including a developer bearing member that develops a latent image formed on the image bearing member.

6. The image-forming apparatus according to claim 5, wherein the engagement member is provided in the image bearing member unit.

7. The image-forming apparatus according to claim 5, wherein movement of the engagement member between the engagement position and the release position causes no change in a relative arrangement of the image bearing member unit and the developer bearing member unit.

8. The image-forming apparatus according to claim 7, wherein the developer bearing member unit includes an engagement portion that engages with the protection member at a location different from a location of the engagement member.

9. The image-forming apparatus according to claim 1, wherein the engagement member is in a groove formed in the cartridge along an attachment direction of the cartridge, and abuts the release member in the groove.

10. The image-forming apparatus according to claim 5, wherein the engagement member is the developer bearing member unit.

11. The image-forming apparatus according to claim 10, wherein the movable member includes a maintaining portion that maintains a posture of the image bearing member unit, when the developer bearing member unit moves from the engagement position to the release position.

12. The image-forming apparatus according to claim 10, wherein in a state where the movable member is at the inside position, a separation distance between the image bearing member and the developer bearing member is changed by moving of the release member relative to the movable member.

13. The image-forming apparatus according to claim 12, wherein the release member includes a lock member that prevents the release member from moving relative to the movable member, in a state where the movable member is at the outside position.

14. The image-forming apparatus according to claim 10, further comprising:

wherein the cartridge includes the urging member that urges the developer bearing member toward the image bearing member, and wherein the image-forming apparatus further includes, a blocking portion configured to prevent the cartridge from being removed from the movable member by an urging force exerted by an urging member, when the cartridge is attached to the attachment portion.

15. The image-forming apparatus according to claim 5, wherein the image bearing member unit includes an engagement portion that engages with the protection member at a location different from a location of the engagement member.

16. The image-forming apparatus according to claim 5, wherein the protection member includes a separation portion that separates the image bearing member and the developer bearing member.

17. The image-forming apparatus according to claim 16, wherein the separation portion is interposed between the image bearing member unit and the developer bearing member unit.

18. The image-forming apparatus according to claim 1, wherein the protection member includes a grip portion provided to be gripped when the cartridge is attached to the attachment portion.

19. The image-forming apparatus according to claim 1, wherein the engagement member pivots between the engagement position and the release position.

20. The image-forming apparatus according to claim 1, wherein the movable member includes an exposure member that allows formation of a latent image on an image bearing member.

* * * * *